US009620263B2

(12) United States Patent
Ogawa et al.

(10) Patent No.: US 9,620,263 B2
(45) Date of Patent: Apr. 11, 2017

(54) BUS BAR, BUS BAR MODULE, AND METHOD OF MANUFACTURING BUS BAR

(71) Applicant: Kobe Steel, Ltd., Hyogo (JP)

(72) Inventors: Tetsuya Ogawa, Kobe (JP); Hideo Fujii, Kobe (JP); Chikara Ichihara, Kobe (JP); Kenichi Inoue, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 22 days.

(21) Appl. No.: 14/436,315

(22) PCT Filed: Dec. 27, 2013

(86) PCT No.: PCT/JP2013/085268

§ 371 (c)(1),
(2) Date: Apr. 16, 2015

(87) PCT Pub. No.: WO2014/104367

PCT Pub. Date: Jul. 3, 2014

(65) Prior Publication Data

US 2015/0255192 A1 Sep. 10, 2015

(30) Foreign Application Priority Data

Dec. 28, 2012 (JP) ..... 2012-286995

(51) Int. Cl.
*H01B 7/30* (2006.01)
*H01B 7/02* (2006.01)
(Continued)

(52) U.S. Cl.
CPC ..... *H01B 7/30* (2013.01); *H01B 7/0241* (2013.01); *H01B 7/306* (2013.01);
(Continued)

(58) Field of Classification Search
CPC ..... H02G 5/005; H01B 7/30; H01B 7/0241; H01B 13/0891
See application file for complete search history.

(56) References Cited

U.S. PATENT DOCUMENTS 4,788,394 A * 11/1988 Vanneste ..... C21D 9/60 219/636
6,005,193 A * 12/1999 Markel ..... H01B 7/30 174/117 F
(Continued)

FOREIGN PATENT DOCUMENTS

JP S50-544 Y1 1/1975
JP S58-156308 U 10/1983
(Continued)

OTHER PUBLICATIONS

International Search Report; PCT/JP2013/085268; Jan. 28, 2014.
Written Opinion of the International Searching Authority; PCT/JP2013/085268; Jan. 28, 2014.

*Primary Examiner* — Hoa C Nguyen
*Assistant Examiner* — Stanley Tso
(74) *Attorney, Agent, or Firm* — Studebaker & Brackett PC

(57) ABSTRACT

A bus bar (1) comprises: a laminated conductive wire (20) formed by arranging side by side in the longitudinal direction a first plate-shaped conductive wire (21) formed by spirally winding stripe conductors (11, 12) mutually adjacent in the width direction while bringing the opposing inner surfaces closer to each other, and a second plate-shaped conductive wire (22) formed by spirally winding the stripe conductors (11, 12) in the direction opposite the direction of the first conductive wire (21) while bringing the opposing inner surfaces closer to each other, and overlapping these wires (21, 22) so that the outer surfaces in the width direction face each other; and terminals (30) joined to the first conductive wire (21) and the second conductive wire (22) at both ends of the laminated conductive wire (20).

9 Claims, 18 Drawing Sheets

(51) Int. Cl.

| | |
|---|---|
| ***H01B 13/08*** | (2006.01) |
| *H01B 5/04* | (2006.01) |
| *H01B 13/00* | (2006.01) |

(52) U.S. Cl.
CPC ..... *H01B 13/0891* (2013.01); *H01B 5/04* (2013.01); *H01B 13/0006* (2013.01); *Y10T 29/49174* (2015.01)

(56) References Cited

U.S. PATENT DOCUMENTS

| | | | | |
|---|---|---|---|---|
| 6,976,762 | B2 * | 12/2005 | Chien | A41D 27/085 313/511 |
| 2008/0130184 | A1 * | 6/2008 | Hartmann | H01C 3/02 361/93.7 |
| 2009/0023345 | A1 | 1/2009 | Matsumoto et al. | |
| 2012/0194311 | A1 * | 8/2012 | Suzuki | H01F 27/266 336/92 |
| 2013/0181796 | A1 * | 7/2013 | Weber | H01F 27/085 336/60 |
| 2014/0000927 | A1 | 1/2014 | Hashimoto et al. | |
| 2015/0255192 | A1 * | 9/2015 | Ogawa | H01B 7/0241 174/74 R |
| 2015/0340139 | A1 * | 11/2015 | Arndt | H01F 41/12 505/211 |

FOREIGN PATENT DOCUMENTS

| | | | |
|---|---|---|---|
| JP | H09-135565 | A | 5/1997 |
| JP | 2006-081373 | A | 3/2006 |
| JP | 2010-246298 | A | 10/2010 |
| WO | 2012/118046 | A1 | 9/2012 |
| WO | 2012/118047 | A1 | 9/2012 |

* cited by examiner

BUS BAR, BUS BAR MODULE, AND METHOD OF MANUFACTURING BUS BAR

TECHNICAL FIELD

The present invention relates to a bus bar used in electric connection, a bus bar module, and a manufacturing method of the bus bar.

BACKGROUND ART

Bus bars and bus bar modules have conventionally been used in electric connection. For example, bus bars and bus bar modules are used in hybrid automobiles and electric automobiles where pulse width modulation (PWM: Pulse Width Modulation) driving control using particularly high-frequency current is performed.

An example of the bus bar used in the system of a hybrid automobile will be described here with reference to PTL 1 and 2. In the example in PTL 1 and 2, bus bars are used for electric connection between the motor and motor inverter, and between the generator and generator inverter, and also for electric power lines within the inverter unit.

Generally, high-frequency current flowing among the motor, generator, and invertor, includes high-frequency wave components due to switching that are as high as several kHz, besides the basic sine wave and DC component. Such high-frequency wave components are induced by eddy current within the bus bar conductor. In the example in PTL 1, the current flow in a manner concentrated beneath the surface skin of a bus bar 101 as illustrated in FIG. 11. The skin depth thereof is obtained as $\delta=(\rho/\pi f\mu)^{1/2}$ from the frequency f of the current and the conductor material of the bus bar 101 constructed of rectangular wire. This lowers the current density flowing thorough the conductor, so the effective resistance within the conductor increases, consequently being manifested as eddy current loss. The eddy current loss is proportionate to the current frequency f squared, so the AC current generated by PWM exhibits marked eddy current loss due to the current with a significantly large high-frequency current flowing through the bus bar 101. Now, FIG. 10 is a graph illustrating the relationship between the frequency of the driving current and the skin depth, for each of various types of conductor materials.

Copper plate-shaped bus bars having a large surface area are used in motors using large currents with high voltage as described in PTL 1, in order to suppress the above-described eddy current loss due to high-frequency waves, and for thermal dissipation. However, the prime power, which is the basic sine waves with relatively low frequencies, and DC component, also flows through the bus bar. Accordingly, forming the bus bar as a flat plate to reduce the cross-sectional area in order to suppress the high-frequency wave components increases the effective resistance for the current handling the prime power, resulting in an increase in so-called copper loss (or iron loss in a case where the material is iron). Further, metal plates formed of material such as copper, which are plate-shaped with a certain degree of thickness, have rigidity to a certain extent, so the forming and wiring implementation thereof is not easy. Accordingly, how to reduce overall transmission loss in bus bars which transmit current in which low-frequency waves through high-frequency waves coexist is an issue.

The high-frequency wave components accompanying PWM also induce reactive voltage proportionate to the product of the inductance and frequency ($V \propto f \cdot L$) in the bus bar, so the faster the switching is, the greater the breakdown voltage of the output stage element of the invertor has to be to deal with surges thereof. Accordingly, the floating inductance of the bus bar or bus bar module is preferably as small as possible.

On the other hand, an assembled rectangular wire where multiple relatively fine rectangular wires have been assembled makes up the bus bar. PTL 2 asserts that this reduces manufacturing costs, enables forming of complicated shapes, and further enables eddy current loss to be suppressed by splitting the current among multiple rectangular wires. According to the description in PTL 2, the wire diameter is reduced to (1/number of coil wires) in a case of configuring the bus bar using multiple rectangular wires, as compared with forming the bus bar of a flat plate. The description states that this suppresses the eddy current loss which is said to be proportionate to the line width squared, and consequently suppresses eddy current loss over the entire bus bar. The description also states that increasing the number of lines and reducing the line diameter of each also enables the loops of the eddy currents flowing through the cross-section to be reduced, and that eddy current loss can be further reduced.

However, the skin effect still remains in a configuration where a bus bar 102 is made up of multiple rectangular wires arrayed sideways in parallel, as illustrated in FIG. 12A. That is to say, assuming that externally-supplied high-frequency current is uniformly split among the rectangular wires making up the bus bar 102, it can be understood that there will be magnetic flux lines surrounding the rectangular wires on the inner side, when considering the high-frequency wave magnetic flux lines excited thereby, as illustrated in FIG. 12B. The two rectangular wires on the outer sides of the magnetic flux lines form a large closed loop, due to being connected by both terminals of the bus bar 102, and the AC magnetic flux lines traverse this loop. The effects of the electromagnetic induction in this state create induced electromotive force in the closed loop, resulting in an eddy current. This eddy current added to the externally supplied current assumed earlier is conceivably the current actually flowing. Consequently, even of the bus bar 102 is divided into multiple rectangular wires, the current flows avoiding the rectangular wires on the inner side, and so an uneven flow occurs where the current is concentrated at the rectangular wires on the outer side. As a result thereof, a current distribution still remains that is the same as that due to the skin effect in the bus bar 101 illustrated in FIG. 11 made up of the multiple rectangular wires arrayed sideways in parallel have been formed integrally. This is the same as forming slits in parallel in a bus bar made up of rectangular wires not affecting the current flowing through the bus bar whatsoever.

In the same way, the skin effect remains even if configuring a bus bar 103 out of multiple rectangular wires arrayed in parallel sideways and vertically as illustrated in FIG. 13A. Obtaining the actual current distribution in the same way as in FIG. 12B shows that the existence of the magnetic flux lines passing through the inside of the rectangular wires on the inner side results in the same sort of uneven current flow in the same way as the skin effect, after all. As a result thereof, a current distribution still remains that is the same as that due to the skin effect in the bus bar 101 illustrated in FIG. 11 made up of the multiple rectangular wires arrayed sideways in parallel have been formed integrally.

Thus, it can be understood that the bus bar structure shown in PTL 2 demonstrates no effects of suppressing eddy current loss whatsoever, although ease of forming and wiring implementation is improved. PTL 2 states that eddy current loss is further reduced by twisting the entire assembled multiple rectangular wires. However, it can be understood that this configuration has no influence on the form or distribution of the AC magnetic flux lines in the cross-sectional diagrams illustrated in FIG. 12B and FIG. 13B, and has no effect of reducing eddy current induced by the AC magnetic flux lines nor power loss occurring thereby. Moreover, twisting the entire assembled rectangular wire is equivalent to having internal inductance as in a solenoid coil, leading to unnecessary increase in inductance.

CITATION LIST

Patent Literature

PTL 1: Japanese Unexamined Patent Application Publication No. 2006-81373

PTL 2: Japanese Unexamined Patent Application Publication No. 2010-246298

SUMMARY OF INVENTION

Technical Problem

As described above, even if a bus bar is configured using multiple conductive wires in parallel as in a conventional arrangement, an eddy current flow through a closed loop via the terminals on both ends of the bus bar, due to electromotive force induced by the high-frequency magnetic flux lines generated within the bus bar. This creates unevenness in the high-frequency current flowing through the conducting members. As a result, a problem occurs that the current distribution is the same as that of the skin effect in the solid conductor bus bar, and the eddy current loss cannot be suppressed.

Accordingly, it is an object of the present invention to provide a bus bar, a bus bar module, and a manufacturing method of a bus bar, whereby eddy current loss due to high-frequency current can be reduced.

Solution to Problem

In order to achieve the above object, a bus bar used for electric connection includes: a laminated conductive wire, where two or more conductive wires, configured by one or a plurality of stripe conductors covered with an insulating film having been wound in a spiral form so as to be adjacent in a width direction of the stripe conductor, are configured in a flat plate form so that opposing surfaces of a wound interior are in proximity or in close contact are disposed side-by-side in a longitudinal direction of each, and overlaid and laminated so that an outer surface of each in the width direction face each other; and terminal parts, disposed on both ends of the laminated conductive wire and bonded to the two conductive wires.

According to this, the stripe conductors of the two conductive wires interchange between the outer side of the laminated conductive wire and the inner side following the longitudinal direction. That is to say, the stripe conductors which where on the surface of the laminated conductive wire enter the interior at the following pitch. Accordingly, current flows through the stripe conductors regardless of outer side/inner side of the laminated conductive wire so effective cross-sectional area can be secured, and suppressing the eddy current loss to a low level enables the skin effect of the high-frequency current to be effectively suppressed. Thus, eddy current loss is suppressed and the skin effect is avoided, and not only low-frequency current but also high-frequency current can be made to flow through the interior of the bus bar, and current can be made to flow at the entire cross-section over a wide frequency range. Accordingly, transmission loss can be effectively suppressed from the low-frequency basic waves to high-frequency waves due to modulation.

Now, in the bus bar according to the present invention, the two conductive wires may include a first conductive wire where one or a plurality of stripe conductors covered with an insulating film are wound in a spiral form so as to be adjacent in a width direction of the stripe conductor, and configured in a flat plate form so that opposing surfaces of a wound interior are in proximity or in close contact, and a second conductive wire where one or a plurality of stripe conductors covered with an insulating film are wound in a spiral form, in an opposite direction to the first conductive wire, so as to be adjacent in a width direction of the stripe conductor, and configured in a flat plate form so that opposing surfaces of a wound interior are in proximity or in close contact.

According to this, the first stripe conductor and second stripe conductor making up the bus bar are wound in opposite direction in spiral form, so the coil-like spiral current causes increase in internal inductance. However, the first conductive wire where the stripe conductors are wound in spiral form and the second conductive wire where the stripe conductors are wound in spiral form in the opposite direction are laminated side-by-side in the longitudinal direction, so the magnetic flux lines spreading in the vicinity of each are canceled out for the greater part. Accordingly, increase in the internal inductance can be minimized as a whole of the bus bar.

Now, in the bus bar according to the present invention, the number of the stripe conductors making of each of the conductive wires may be the same, and the width of the stripe conductors making of each of the conductive wires may be the same. Further, the number of stripe conductors making up each of the two conductive wires may be two.

Accordingly, when viewing from the longitudinal direction of the bus bar, the first conductive wire and second conductive wire can be deemed to be two solenoid coils with circling currents of opposite directions to each other. These two solenoid coils are disposed in sufficient proximity, and the magnetic flux line which each creates externally is opposite in direction, so overlaying the two cancels each other out. That is to say, the internal inductance generated due to the structure of the laminated conductive wire making up the bus bar is proportionate to the expansion of the magnetic flux lines generated by the high-frequency current (the volume integration of the magnetic flux density). Accordingly, the magnetic flux lines do not expand externally from the bus bar with the two pairs wound with the same number of winds but in opposite winds to each other, yielding the advantage that internal induction is minimized. This is also advantageous in that the structure is simple and forming and wiring implementation is easy. Also, in a case where the number of stripe conductors making up the two conductive wires is the same, and the stripe conductors making these up are of the same width, there is the advantage that the structure is simple where the width of the bus par and the spiral pitch can be suitably combined, and the number of parts is few, which is most preferable regarding forming and wiring implementation.

Also, the aspect ratio of thickness of the laminated conductive wire as to the width thereof may be 1 or smaller.

According to this the cross-sectional shape of the laminated conductive wire in the width direction changes from a square to a rectangle. In a case of the generally square cross-sectional shape of the laminated conductive wire in the width direction where the aspect ratio of thickness of the laminated conductive wire as to the width thereof is 1, the surface area of the bus bar is the smallest in the conventional rectangular line structure bus bar, and the eddy current loss is maximal. However, in the bus bar according to the present invention, the stripe conductors of the first conductive wire and the second conductive wire interchange between the outer side of the laminated conductive wire and the inner side following the longitudinal direction, and current flows through the stripe conductors regardless of outer side/inner side of the laminated conductive wire so effective cross-sectional area can be secured, and suppressing the eddy current loss to a low level enables the skin effect of the high-frequency current to be effectively suppressed.

Also, in the bus bar according to the present invention, with the width of the laminated conductive wire as W, the thickness of the laminated conductive wire 20 as T, the width of the stripe conductors 11 and 12 as ω, and half of the spiral pitch of the stripe conductors as λ, a combination of the dimensional ratios of T/W and λ/W regarding the skin depth $\delta=(\rho/\pi f\mu)^{1/2}$ from the frequency f of the current which the bus bar conducts and the resistivity ρ and magnetic permeability μ of the stripe conductors satisfies the following Expression (1).

[Math 1]

$$\left.\begin{array}{l} \dfrac{1}{\omega/W}\cdot\dfrac{\sqrt{(\lambda/W)^2+1}}{\lambda/W}(1+T/W)\cdot\dfrac{2\delta}{T}\leq 1 \\ \text{or} \\ \dfrac{1}{\omega/W}\cdot\dfrac{\sqrt{(\lambda/W)^2+1}}{\lambda/W}(1+T/W)\leq\dfrac{T}{2\delta_{(f)}} \\ \text{where } \lambda\langle\langle L\ (L\text{: line length}) \end{array}\right\} \quad (1)$$

Configuring a bus bar combining the geometric parameters T/W and λ/W obtained based on Expression (1) results in the value of the AC resistance in the bus bar having a conventional rectangular wire structure in which the width-direction cross-sectional shape is approximately the same dimensions, as to the AC resistance of the bus bar according to the present invention, to be 1 or lower. Thus, AC resistance can be reduced (improved).

Now, with a gap between the first conductive wire and second conductive wire as δt and the thickness of the stripe conductors as Tt, the dimensional ratio may be such that the ratio δt/Tt of δt as to Tt is 1 or smaller.

This narrows the gap between the first conductive wire and second conductive wire, in which the stripe conductors making up the spirals of the bus bar are wound in spiral forms in opposite directions, which causes attenuation of the magnetic flux lines entering between the first conductive wire and second conductive wire. Thus, increase in the internal inductance can be suppressed for the entire bus bar.

Now, the bus bar may be used for electric connection to conduct pulse width modulated current.

Current with a markedly great high-frequency component flows to the bus bar with the AC current according to pulse width modulation, so eddy current loss is significant in the conventional rectangular wire structure. However, using the bus bar according to the present invention enables eddy current loss to be reduced.

Now, the bus bar may be used for electric connection between an electric motor and an inverter.

Driving current supplied from an inverter to an electric motor includes switching noise due to pulse width modulation, i.e., high-frequency component, to a certain extent. Using the bus bar according to the present invention enables eddy current loss to be reduced.

A bus bar module according to the present invention is formed by integrally assembling a plurality of bus bars formed in a predetermined shape, disposed in close contact so that surfaces thereof in the width direction face one another.

Accordingly, the bus bar module can be used for driving a three-phase motor of the like, by assembling three bus bars, for example, integrally.

A bus bar manufacturing method according to the present invention is bus bar manufacturing method of manufacturing a bus bar used for electric connection. The method includes: a conductive wire winding process of winding one or a plurality of stripe conductors, covered by an insulating film, in a spiral form such that the stripe conductors are arrayed adjacently in the width direction of the stripe conductors, to configure two conducting wound members; a conductive wire flattening process of forming the two conducting wound members into plate forms by flattening processing, to configure two conductive wires; a laminating process of arraying the two conductive wires side-by-side in the longitudinal direction, and laminating by overlaying the two conductive wires with the surface of each in the width direction facing each other, to configure a laminated conductive wire; and a terminal part bonding processes of disposing terminal parts for electric connection at both ends of the laminated conductive wire, and bonding to the two conductive wires.

According to this, the stripe conductors of the two conductive wires interchange between the outer side of the laminated conductive wire and the inner side following the longitudinal direction. That is to say, the stripe conductors which were on the surface of the laminated conductive wire enter the interior at the following pitch due to the structure of being wound in spiral form. Accordingly, current flows through the stripe conductors regardless of outer side/inner side of the laminated conductive wire so effective cross-sectional area can be secured, and suppressing the eddy current loss to a low level enables the skin effect of the high-frequency current to be effectively suppressed. Thus, eddy current loss is suppressed and the skin effect is avoided, and not only low-frequency current but also high-frequency current can be made to flow through the interior of the bus bar, and current can be made to flow at the entire cross-section over a wide frequency range. Accordingly, transmission loss can be effectively suppressed from the low-frequency basic waves to high-frequency waves due to modulation.

In the bus bar manufacturing method according to the present invention, the conductive wire winding process may include a first conductive wire winding process of winding one or a plurality of stripe conductors, covered by an insulating film, in a spiral form such that the stripe conductors are arrayed adjacently in the width direction of the stripe conductors, to configure a first conducting wound member, and a second conductive wire winding process of winding one or a plurality of stripe conductors, covered by an insulating film, in a spiral form opposite to the direction of the first conducting wound member such that the stripe conductors are arrayed adjacently in the width direction of the stripe conductors, to configure a second conducting wound member. In the conductive wire flattening process, the first conducting wound member may be formed into a plate form by flattening processing, to configure a first conductive wire, and the second conducting wound member may be formed into a plate form by flattening processing, to configure a second conductive wire. In the laminating process, the first conductive wire and the second conductive wire may be arrayed side-by-side in the longitudinal direction, and laminated by overlaying the first conductive wire and the second conductive wire with the surface of each in the width direction facing each other, to configure a laminated conductive wire. In the terminal part bonding process, terminal parts for electric connection may be disposed at both ends of the laminated conductive wire, and bonded to the first conductive wire and the second conductive wire.

According to this, the stripe conductors are wound in opposite direction in spiral form, so the coil-like spiral current causes increase in internal inductance. However, the first conductive wire where the stripe conductors are wound in spiral form and the second conductive wire where the stripe conductors are wound in spiral form in the opposite direction are laminated side-by-side in the longitudinal direction, so the magnetic flux lines spreading in the vicinity of each are canceled out for the greater part. Accordingly, increase in the internal inductance can be minimized as a whole of the bus bar.

Advantageous Effects of Invention

According to the bus bar, bus bar module, and manufacturing method the bus bar, according to the present invention, eddy current loss due to high-frequency current can be reduced.

DESCRIPTION OF EMBODIMENTS

An embodiment for carrying out the bus bar and bus bar module, and the manufacturing method of the bus bar according to the present invention, will be described by way of a specific example, with reference to the drawings. Note that the following description is only exemplary, and does not show restrictions of application of the bus bar and bus bar module, and the manufacturing method of the bus bar according to the present invention. That is to say, the bus bar and bus bar module and the manufacturing method of the bus bar according to the present invention are not restricted to the following embodiment, and that various modifications may be made within the scope of the Claims set forth.

Figure 1:
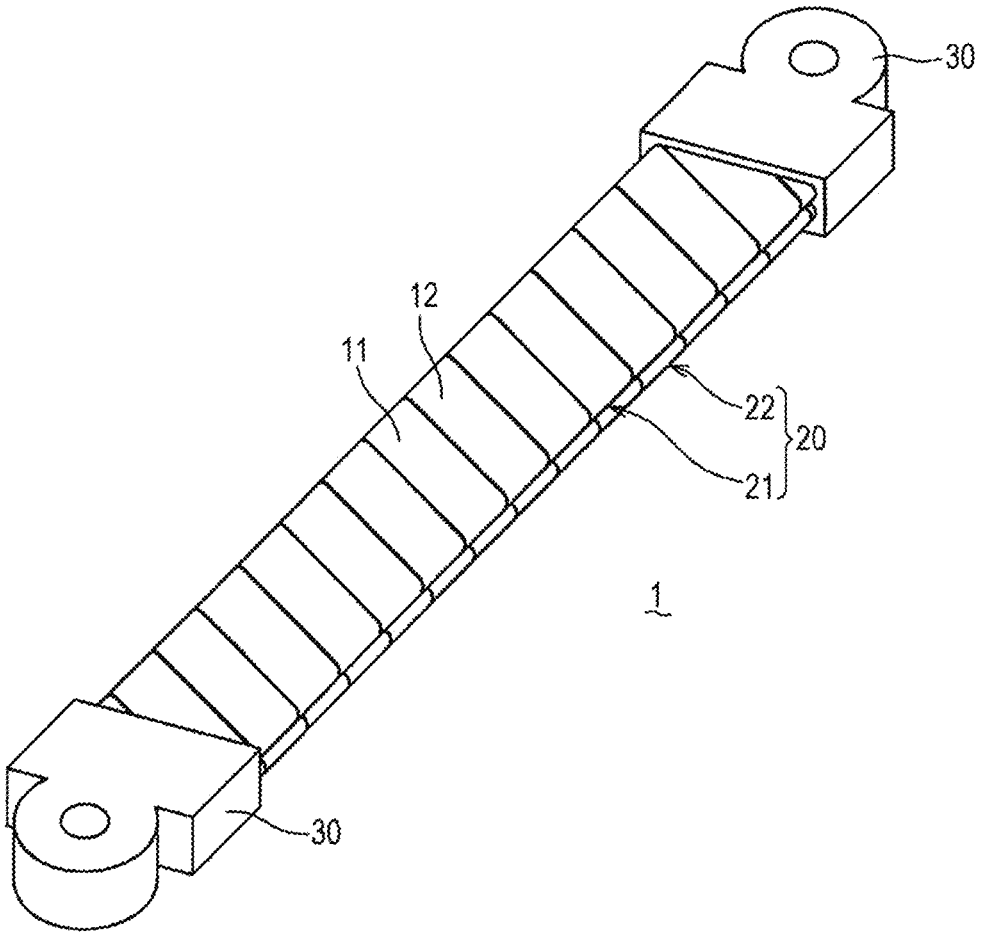
FIG. 1 is a perspective view illustrating a bus bar according to the present embodiment.

A bus bar 1 illustrated in FIG. 1 and a bus bar module 2 illustrated in FIG. 8 are used for electric connection, and particularly used for conducting current subjected to pulse width modulation (PWM). For example, bus bars and bus bar modules are used for electric connection between an electric motor and an inverter, electric connection between a three-phase AC motor for inverter control and an inverter, electric connection between a power source and an inverter, electric connection between an AC control device that controls inverters and an inverter, electric connection between various types of control devices and a power source, electric connection among various types of control devices, and so forth. The bus bar and bus bar module, and the manufacturing method of the bus bar, according to the present invention, will be described below.

[Bus Bar]

Figure 2:
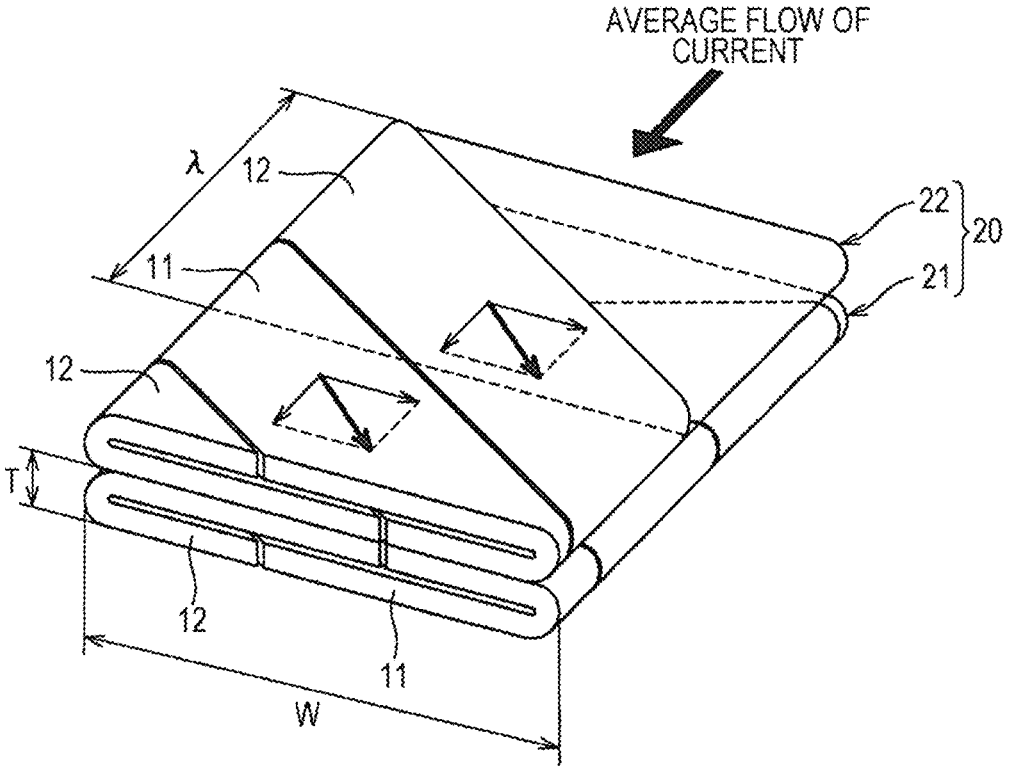
FIG. 2 is a perspective cross-sectional view illustrating a part of a laminated conductive wire configuring the bus bar according to the present embodiment.
Figure 3:
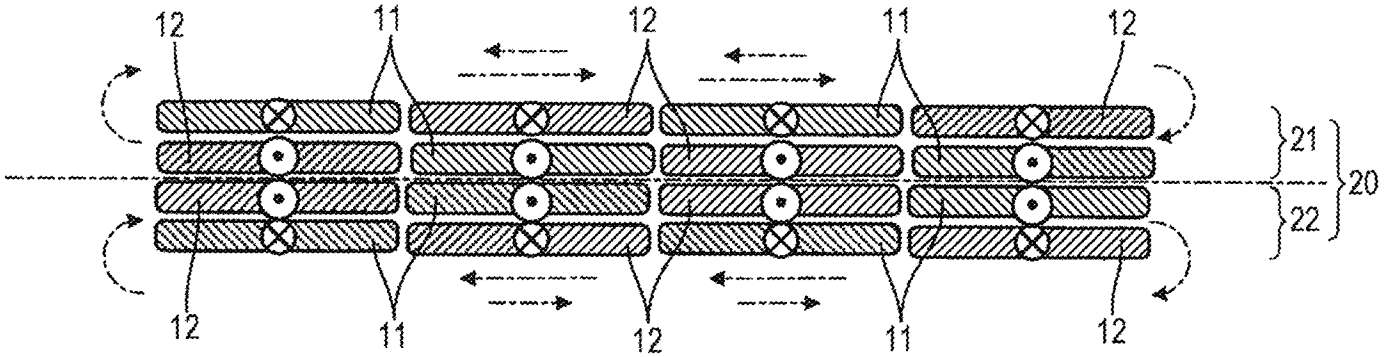
FIG. 3 is a longitudinal-direction cross-sectional view of the laminated conductive wire configuring the bus bar according to the present embodiment.
Figure 4A:
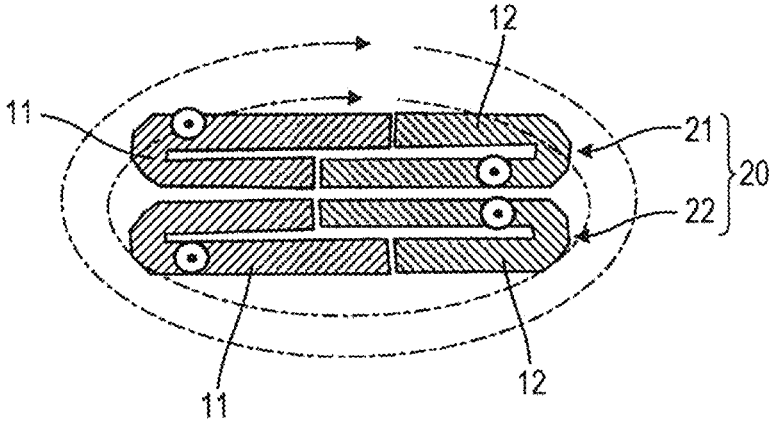
FIG. 4A is a lateral-direction cross-sectional view of the laminated conductive wire configuring the bus bar according to the present embodiment.
Figure 4B:
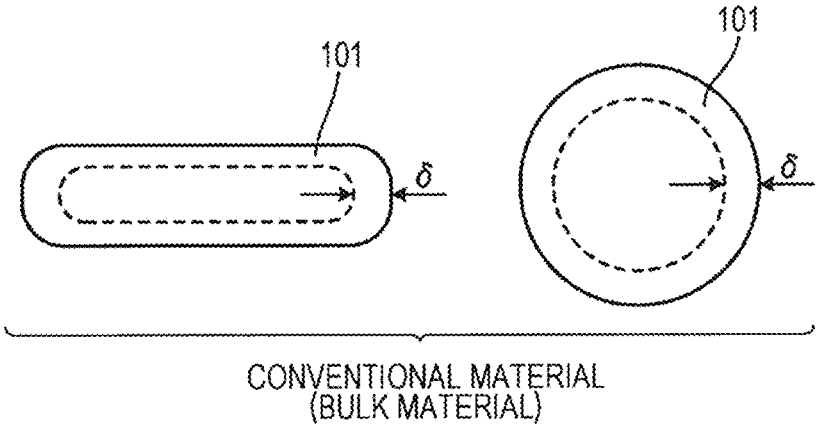
FIG. 4B is a lateral-direction cross-sectional view of a bus bar according to the conventional art.
Figure 5:
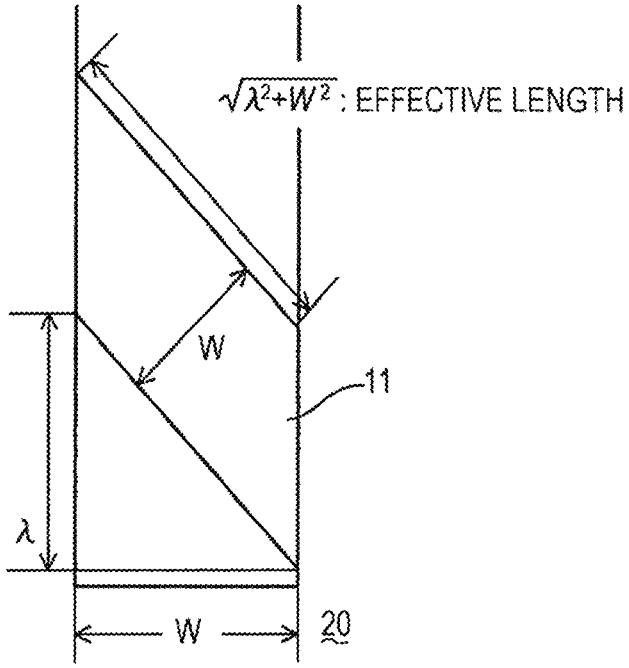
FIG. 5 is a plan view illustrating dimensions of a laminated conductive wire configuring the bus bar according to the present embodiment.
Figure 6:
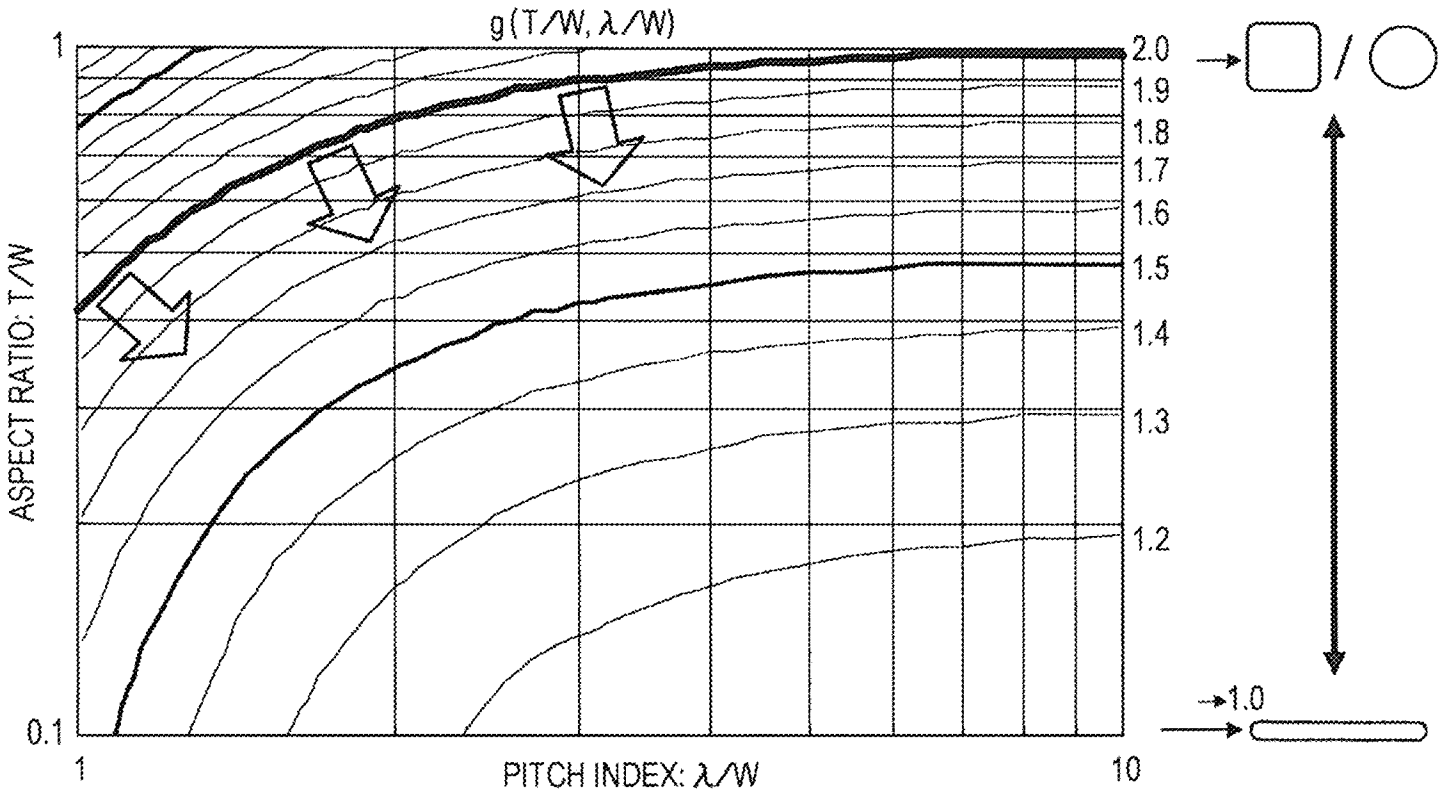
FIG. 6 is a graph illustrating combinations of geometric parameters T/W and λ/W applied to the bus bar according to the present embodiment.
Figure 7:
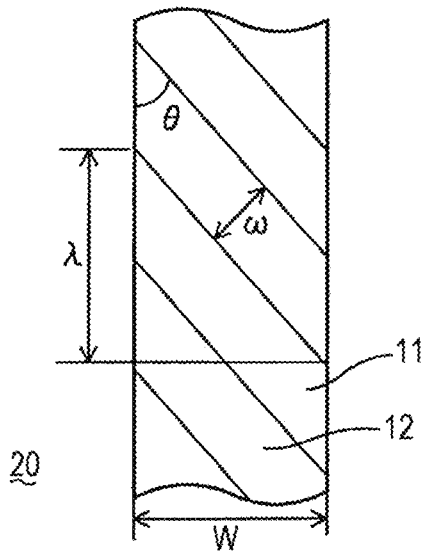
FIG. 7 is a plan view illustrating dimensions of a laminated conductive wire configuring the bus bar according to the present embodiment.

The bus bar according to the present embodiment will be described based on FIG. 1 through FIG. 7. FIG. 1 is a perspective view illustrating a bus bar according to the present embodiment. FIG. 2 is a perspective cross-sectional view illustrating a part of a laminated conductive wire configuring the bus bar according to the present embodiment. FIG. 3 is a longitudinal-direction cross-sectional view of the laminated conductive wire configuring the bus bar according to the present embodiment. FIG. 4A is a lateral-direction cross-sectional view of the laminated conductive wire configuring the bus bar according to the present embodiment. FIG. 4B is a lateral-direction cross-sectional view of a bus bar according to the conventional art. FIG. 5 is a plan view illustrating dimensions of a laminated conductive wire configuring the bus bar according to the present embodiment. FIG. 6 is a graph illustrating combinations of geometric parameters T/W and λ/W applied to the bus bar according to the present embodiment. FIG. 7 is a plan view illustrating dimensions of a laminated conductive wire configuring the bus bar according to the present embodiment.

As illustrated in FIG. 1, the bus bar 1 is configured including a laminated conductive wire 20 made up of a first conductive wire 21 and a second conductive wire 22, which are two conductive wires, and terminal parts 30 disposed on both ends of the laminated conductive wire 20.

The terminal parts 30 are bonded to the first conductive wire 21 and the second conductive wire 22, and thus disposed on both ends of the laminated conductive wire 20, as illustrated in FIG. 1. The terminal parts 30 are connected to corresponding terminal parts of invertors or power sources or the like, to which electric connection is to be made.

The first conductive wire 21 is formed by two stripe conductors 11 and 12 which are covered with an insulating film and have the same width w and thickness, and are wound in a spiral form at a spiral pitch of 2λ, so that the stripe conductors 11 and 12 are arrayed adjacently in the width direction, as illustrated in FIG. 1 and FIG. 2. The spiral pitch here means the length in the spiral axis direction per spiral wind. The first conductive wire 21 is configured as a flat plate having a width of W and a thickness of T/2, with the internal opposing back faces that have been wound in close proximity or in close contact, as illustrated in FIG. 2.

The second conductive wire 22 also is formed by the two stripe conductors 11 and 12 which are covered with an insulating film and have the same width w and thickness, and are wound in a spiral form at a spiral pitch of 2λ, so that the stripe conductors 11 and 12 are arrayed adjacently in the width direction, but wound on the opposite direction from the first conductive wire 21, as illustrated in FIG. 1 and FIG. 2. The second conductive wire 22 is configured as a flat plate having a width of W and a thickness of T/2, with the internal opposing back faces that have been wound in close proximity or in close contact, as illustrated in FIG. 2.

The stripe conductors 11 and 12 are formed of one of aluminum, copper, aluminum alloy, and copper alloy, or have one of these as the primary material thereof. An example of aluminum which can be applied is 1060 (pure aluminum). Using 1060 (pure aluminum) as the stripe conductors 11 and 12 yields even better electroconductive properties. An example of aluminum alloy is 6061 (aluminum to which minute amounts of manganese and silicon have been added) or the like. Using aluminum alloy as a conductor yields even better strength. Examples of copper include oxygen-free copper (OFC), touch-pitch copper, and so forth. Examples of copper alloy include precipitation copper alloy where minute amounts of iron and phosphorus have been added to copper, more particularly "KFC" (registered trademark), for example. Using this "KFC" (registered trademark) as the stripe conductors 11 and 12 enables the adherence between the stripe conductors 11 and 12 and insulating film (omitted from illustration) to be raised, so that the insulating film does not readily peel off (boundary separation strength to be raised). The insulating film is formed of a compound of organic material and inorganic material, or of an organic material, the organic material is formed of one or multiple selected from thermoplastic resin, thermosetting resin, and rubber. Specific example which may be used include imide resins of which polyimide, polyamide-imide, polyester-imide are representative. The inorganic material is formed of one or multiple selected from crystalline silica powder, molten silica powder, glass fiber, talc powder, mica powder, aluminum oxide powder, magnesium oxide powder, aluminum nitride powder, boron nitride powder, silicon nitride powder, and silicon carbide powder. The insulating film is not necessarily restricted to an applied or encasing film material, and may be an enamel or polyvinyl formal coating obtained by coating and then polymerization processing by heating or the like. In a case where the conductor is an aluminum, this may be an oxidization film formed on the surface by oxalic processing or anodization. Materials are optionally selected according to the bus bar 1.

The laminated conductive wire 20 is formed by the first conductive wire 21 and second conductive wire 22 each extending side-by-side in in the longitudinal direction, and being overlaid and laminated so that the surfaces of the first conductive wire 21 and second conductive wire 22 on the outer sides thereof in the width W direction face each other. The laminated conductive wire 20 is thus formed in the shape of a plate with a width W and thickness T.

Now, the laminated conductive wire 20 is formed so that the aspect ratio of the thickness T as to the width W is 1 or smaller ($T \leq W$). That is to say, the laminated conductive wire 20 may be configured such that the aspect ratio of the thickness T of the laminated conductive wire 20 as to the width W is 1, so that the width-wise cross-sectional shape is generally square. Alternatively, the laminated conductive wire 20 may be formed such that the aspect ratio of the thickness T as to the width W is smaller than 1, so that the width-wise cross-sectional shape is generally rectangular so as to be flat in the sideways direction.

Also, as illustrated in FIG. 7, with the width of the laminated conductive wire 20 as W, the thickness of the laminated conductive wire 20 as T, the width of the stripe conductors 11 and 12 as ω, and half of the spiral pitch of the stripe conductors 11 and 12 as λ, as described above, a combination of the dimensional ratios of T/W and λ/W regarding the skin depth $\delta=(\rho/\pi f\mu)^{1/2}$ from the frequency f of the current which the bus bar 1 conducts and the resistivity ρ and magnetic permeability μ, of the stripe conductors 11 and 12, preferably satisfies the following Expression (1).

[Math 2]

$$\left.\begin{array}{l} \dfrac{1}{\omega/W}\cdot\dfrac{\sqrt{(\lambda/W)^2+1}}{\lambda/W}(1+T/W)\cdot\dfrac{2\delta}{T}\leq 1 \\ \text{or} \\ \dfrac{1}{\omega/W}\cdot\dfrac{\sqrt{(\lambda/W)^2+1}}{\lambda/W}(1+T/W)\leq\dfrac{T}{2\delta_{(f)}} \\ \text{where}\ \ \lambda\langle\langle L\ (L\text{: line length}) \end{array}\right\} \quad (1)$$

Expression (1) illustrates the conditions for the geometric shape of the bus bar 1 according to the present embodiment to have reduced AC resistance and suppressed eddy current loss as compared to the bus bar of the conventional art. Expression (1) is obtained by expanding and organizing so that the ratio η(f) of the AC resistance $R^{AC}$ of the bus bar according to the present embodiment in FIG. 7 is 1 or less as to the AC resistance $R^{AC}{}_{bulk}$ of a conventional bus bar having a conventional rectangular wire structure where the width-wise cross-sectional shape has approximately the same dimensions. The calculation process is as shown in the following Expression (2).

[Math 3]

$$\left.\begin{array}{l} \text{Under the conditions of } 2\delta_{(f)}\leq T\leq W, \\ \eta(f)\leq 1,\ \text{i.e.,}\ \ R^{AC}_{(f)}\leq R^{AC}_{bulk(f)} \\ \eta(f)\equiv\dfrac{R^{AC}_{(f)}}{R^{AC}_{bulk(f)}}=\dfrac{\rho\dfrac{1}{\omega T}\dfrac{1}{\lambda\cos\theta}}{\rho\dfrac{1}{\delta 2(W+T)}\dfrac{1}{\lambda}} \\ \quad=\dfrac{1}{\dfrac{\omega}{W}\cos\theta}\left(1+\dfrac{T}{W}\right)\cdot\dfrac{2\delta}{T} \\ \quad=\dfrac{\sqrt{(\lambda/W)^2+1}}{\lambda/W}\cdot\dfrac{1}{\omega/W}(1+T/W)\cdot\dfrac{2\delta}{T} \\ \text{where} \\ \tan\theta=\dfrac{1}{\lambda/W} \\ \dfrac{1}{\cos\theta}=\sqrt{1+\tan^2\theta}=\dfrac{\sqrt{(\lambda/W)^2+1}}{\lambda/W} \end{array}\right\} \quad (2)$$

If the above-described ratio η(f) is smaller than 1, the AC resistance $R^{AC}$ of the bus bar 1 according to the present embodiment is smaller than the AC resistance $R^{AC}{}_{bulk}$ of the conventional bus bar having approximately the same dimensions for the width-direction cross-sectional shape. That is to say, a ratio η(f) that is smaller than 1 means reduced eddy current loss. The bus bar 1 according to the present embodiment has a combination of the dimensional ratios of T/W and λ/W satisfying Expression (1), whereby the bus bar 1 according to the present embodiment has reduced AC resistance, reduced notational effect, and suppressed eddy current loss, as compared to the bus bar according to the conventional art.

Further, thought will be given to a case where the width of the laminated conductive wire 20 and the width of the stripe conductors 11 and 12 are the same (W=ω) in the bus bar 1 according to the present embodiment, as illustrated in FIG. 5. In this case, the combination of the dimensional ratios of T/W and λ/W regarding the skin depth $\delta=(\rho/\pi f\mu)^{1/2}$ from the frequency f of the current which the bus bar 1 conducts and the resistivity ρ and magnetic permeability μ of the stripe conductors 11 and 12, preferably satisfies the following Expression (3).

[Math 4]

$$\left.\begin{array}{l} g(T/W,\lambda/W)\cdot\dfrac{2\delta_{(f)}}{T}\leq 1 \\ \text{or} \\ g(T/W,\lambda/W)\leq\dfrac{T}{2\delta_{(f)}} \\ \text{where} \\ g(T/W,\lambda/W)\equiv\dfrac{\sqrt{(\lambda/W)^2+1}}{\lambda/W}(1+T/W) \\ \text{where}\ \ h\langle\langle L\ (L\text{: line length}) \end{array}\right\} \quad (3)$$

Expression (3) is obtained by expanding and organizing so that the ratio η(f) of the AC resistance $R^{AC}$ of the bus bar having the dimensions of the laminated conductive wire illustrated in FIG. 5 is 1 or less as to the AC resistance $R^{AC}{}_{bulk}$ of a conventional bus bar having a rectangular wire structure of which the width-wise cross-sectional dimensions are approximately the same. The calculation process is as shown in the following Expression (4).

[Math 5]

$$\left.\begin{array}{l} \text{Under the conditions of } 2\delta_{(f)}\leq T\leq W, \\ \eta(f)\leq 1,\ \text{i.e.,}\ \ R^{AC}_{(f)}\leq R^{AC}_{bulk(f)} \\ \eta(f)\equiv\dfrac{R^{AC}_{(f)}}{R^{AC}_{bulk\ (f)}} \\ \quad\propto\dfrac{\dfrac{\sqrt{W^2+\lambda^2}}{T\cdot W}}{\delta_{(f)}\cdot 2(T+W)} \\ \quad=\sqrt{\dfrac{(\lambda/W)^2+1}{\lambda/W}}\cdot(1+T/W)\cdot\dfrac{2\delta_{(f)}}{T} \\ \quad\rightarrow(1+T/W)\cdot\dfrac{2\delta_{(f)}}{T} \\ \quad\text{at}\ (\lambda/W\rightarrow\infty\text{: bulk}) \end{array}\right\} \quad (4)$$

The Expression (2) derived from the Expression (4) is expressed as the product of a non-dimensional geometric parameter g (T/W, λ/W) stipulating the structure of the bus bar 1 according to the present embodiment, and twice the skin depth that has been made non-dimensional (by dividing by the thickness T of the bus bar 1) (2δ/T). Here, FIG. 6 illustrates a representation of values where the geometric parameter g (T/W, λ/W) is 1.2 to 2.0 as two-dimensional planar contour lines of (T/W)–(λ/W). A side where a value obtained by multiplying the value of a contour line by the value of 2δ/T is 1 or smaller stipulates the geometric shape of the bus bar 1 according to the present embodiment whereby the improvement effect of reduced eddy current loss can be expected to be yielded. Note that the right side in FIG. 6 illustrates examples of shapes according to aspect ratio, where in a case that the aspect ratio T/W is 0.1 the shape is a flat plate, and in a case where the aspect ratio T/W is 1 the shape is a square post or cylinder.

With a gap between the first conductive wire 21 and second conductive wire 22 as δt and the thickness of the stripe conductors 11 and 12 as Tt, the dimensional ratio is preferably such that the ratio δt/Tt of δt as to Tt is 1 or smaller. Narrowing the gap between the first conductive wire 21 and second conductive wire 22, in which the stripe conductors making up the spirals of the bus bar 1 are wound in spiral forms in opposite directions, causes attenuation of the magnetic flux lines entering between the first conductive wire 21 and second conductive wire 22. Thus, increase in the internal inductance can be suppressed for the entire bus bar.

Now, the direction of the high-frequency current that is externally supplied, and the state of the AC magnetic flux lines induced thereby, at the traverse direction cross-section and longitudinal direction cross-section of the laminated conductive wire 20 making up the bus bar 1 will be described based on FIG. 2 through FIG. 4. The current flowing through of each of the stripe conductors 11 and 12 wound in spiral shapes opposite to each other have an angle as to the longitudinal direction of the laminated conductive wire 20, as illustrated in FIG. 2, so the current can be considered separately regarding the longitudinal component and a component perpendicular thereto. As illustrate in FIG. 4A, when viewing the traverse direction cross-section of the laminated conductive wire 20, the two stripe conductors 11 and 11, and 12 and 12 of the first conductive wire 21 and second conductive wire 22 disposed vertically in the thickness direction flow in the longitudinal direction while interchanging between the outer side (surface of the laminated conductive wire 20) of the laminated conductive wire 20 and the inner side (the interior of the laminated conductive wire 20, i.e., the plane of laminating where the first conductive wire 21 and second conductive wire 22 are laminated). That is to say, the stripe conductors 11 and 12 at the surface of the laminated conductive wire 20 are wound in spiral shapes opposite to each other, and due to this structure, enter the interior at the following pitch. Accordingly, uneven current due to surface effect does not occur, and the same current flows through the stripe conductors 11 and 12. That is to say, the current flows in an average and uniform manner at the traverse direction cross-section of the laminated conductive wire 20 (i.e., bus bar 1), as illustrated in FIG. 2. Note that FIG. 4B illustrates the current distribution in a case of a conventional bulk material bus bar (rectangular and circuit). The high-frequency current is concentrated in the thin layer at beneath the surface skin δ due to the surface effect, in both the rectangular and circular shapes in the conventional bulk material bus bar.

On the other hand, when viewing the laminated conductive wire 20 (i.e., bus bar 1) at the longitudinal direction cross-section as illustrated in FIG. 3, the two pairs of first conductive wire 21 and second conductive wire 22 disposed vertically in the thickness direction can be deemed to be two solenoid coils with circling currents of opposite directions to each other, as if it were. If these two solenoid coils are disposed in sufficient proximity, the magnetic flux line which each creates externally is opposite in direction, so overlaying the two of the first conductive wire 21 and second conductive wire 22 as the laminated conductive wire 20 cancels each other out. That is to say, the internal inductance generated according to the structure of the bus bar 1 according to the present embodiment is proportionate to the expansion of the magnetic flux lines generated by the high-frequency current, i.e., proportionate to the volume integration of the magnetic flux density. Thus, the bus bar 1 according to the present embodiment exhibits an advantage in that the magnetic flux lines do not spread outside of the bus bar 1, and that internal inductance is minimized.

Thus, according to the bus bar 1 of the present embodiment, the stripe conductors 11 and 12 of the first conductive wire 21 and the second conductive wire 22 change places between the surface of the laminated conductive wire 20 which is the outer side, and the interior of the laminated conductive wire 20 which is the inner side, in the longitudinal direction of the laminated conductive wire 20 making up the bus bar 1. Accordingly, current flows through the stripe conductors 11 and 12 regardless of outer side/inner side of the laminated conductive wire 20 so effective cross-sectional area can be secured, and suppressing the eddy current loss to a low level enables the skin effect of the high-frequency current to be effectively suppressed. Also, the stripe conductors 11 and 12 are wound in opposite direction in spiral form, so the coil-like spiral current causes increase in internal inductance. However, the first conductive wire 21 where the stripe conductors 11 and 12 are wound in spiral form and the second conductive wire 22 where the stripe conductors 11 and 12 are wound in spiral form in the opposite direction are laminated side-by-side in the longitudinal direction, so the magnetic flux lines spreading in the vicinity of each are canceled out for the greater part. Accordingly, increase in the internal inductance can be minimized as a whole of the bus bar 1. Thus, the eddy current loss is suppressed and the skin effect is avoided, and not only low-frequency current but also high-frequency current can be made to flow through the interior of the bus bar 1, and current can be made to flow at the entire cross-section over a wide frequency range. Accordingly, transmission loss can be effectively suppressed from the low-frequency basic waves to high-frequency waves due to modulation.

Also, the internal inductance generated due to the structure of the laminated conductive wire 20 making up the bus bar 1 is proportionate to the expansion of the magnetic flux lines generated by the high-frequency current, i.e., proportionate to the volume integration of the magnetic flux density. Accordingly, the magnetic flux lines do not expand externally from the bus bar 1 where the laminated conductive wire 20 is configured by the two sets of rectangular conductive wires first conductive wire 21 and second conductive wire 22 being wound with the same number of winds but in opposite winds to each other, yielding the advantage that internal induction is minimized. Further, the number of the stripe conductors 11 and 12 making up the first conductive wire 21 and second conductive wire is two and the widths are the same, which is a structure enabling easy matching between the bus bar width and the spiral pitch. Moreover, the number of parts is few, which is preferable regarding forming and wiring implementation.

[Bus Bar Module]

Figure 8A:
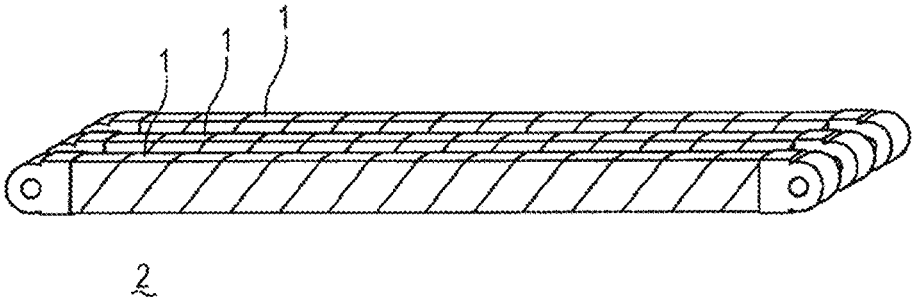
FIG. 8A is a perspective view illustrating a bus bar module according to the present embodiment.
Figure 8B:
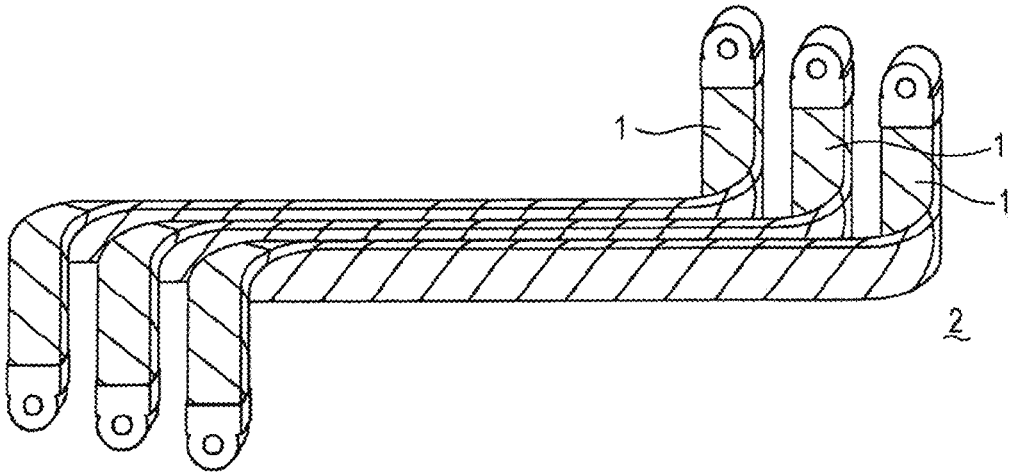
FIG. 8B is a perspective view illustrating a bus bar module according to the present embodiment.

The bus bar module according to the present embodiment will be described based on FIG. 8A and FIG. 8B. FIG. 8A and FIG. 8B are perspective views illustrating the bus bar module according to the present embodiment.

FIG. 8A and FIG. 8B illustrate the bus bar module 2 where three bus bars 1 according to the present embodiment described above form one set. FIG. 8A illustrates a straight type, and FIG. 8B illustrates a crank type. Any wiring installation of the bus bar module 2 can be performed by combining the straight type and the crank type. Also, adding twisting deformation to the linear portion of the bus bar module 2 enables flexibility and freedom in connection angle to be ensured. While the bus bar module 2 has three bus bars 1 integrated as one set, this is not restrictive, and a plurality may be integrated as one set.

The effective inductance of the bus bar module 2 is the total of the internal inductance of each individual bus bar 1, and the external inductance owing to a spatial circuit formed by the layout of the three bus bars 1. The former inner inductance is minimized by the structure of the bus bar 1 according to the present embodiment described above. The latter external inductance is proportionate to the gap between the three bus bars 1, which can be minimized by forming the cross-sections of the bus bar 1 to be thin plate shapes which are plate-shaped and flat, and overlaying so the width direction surfaces facing each outer without gaps. The examples of the bus bar module 2 according to the present embodiment illustrated in FIG. 8A and FIG. 8B have twisting deforming applied to the linear portions of the bus bar module 2, which enables external inductance to be minimized while ensuring flexibility and freedom in connection angle.

Thus, according to the bus bar module 2 of the present embodiment, the three bus bars 1 are assembled in an integrated manner, so the formed bus bar module 2 can be used for driving a three-phase motor or the like.

[Manufacturing Method of Bus Bar]

A manufacturing method of the bus bar according to the present embodiment will be described with reference to FIG. 9A through FIG. 9D. FIG. 9A through FIG. 9D are perspective views illustrating procedures for processes of the manufacturing method according to the present embodiment.

Figure 9A:
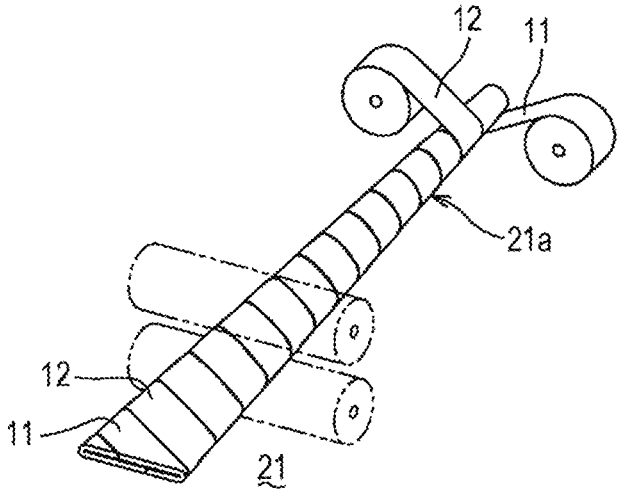
FIG. 9A is a perspective view illustrating procedures for processes of a manufacturing method according to the present embodiment.

First, in a first conductive wire winding process (conductive wire winding process) the two stripe conductors 11 and 12 covered by the insulating film are wound in spatial shapes, by winding onto a cylindrical core for example, such that the stripe conductors 11 and 12 are arrayed adjacently in the side direction thereof, as illustrated in FIG. 9A. Accordingly, a first conducting wound member 21*a*, which is one of the two conducting wound members, is formed. In a conductive wire flattening process, the first conducting wound member 21*a* is formed into a plate shape by flattening processing, thereby forming the first conductive wire 21. This flattening process brings the opposing surfaces that have been wound on the interior of the first conducting wound member 21*a* into close proximity or close contact, thus forming a flat-plate shaped first conductive wire 21.

Figure 9B:
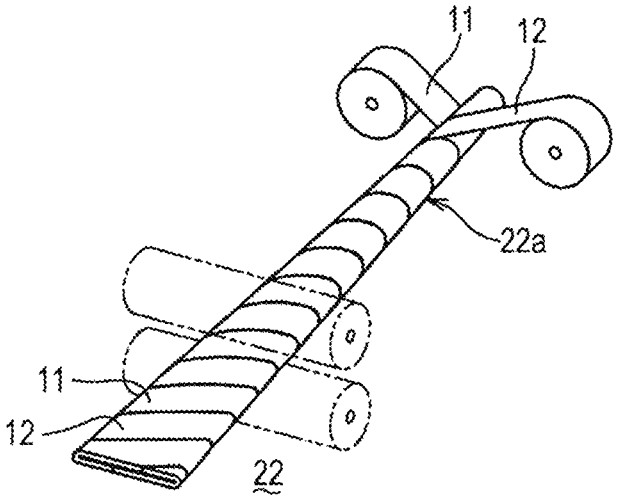
FIG. 9B is a perspective view illustrating procedures for processes of the manufacturing method according to the present embodiment.

Next, in a second conductive wire winding process (conductive wire winding process) the two stripe conductors 11 and 12 covered by the insulating film are wound ins spatial shapes, by winding onto a cylindrical core for example, such that the stripe conductors 11 and 12 are arrayed adjacently in the side direction thereof, in the opposite direction as to the first conductive wire 21, as illustrated in FIG. 9B. Accordingly, a second conducting wound member 22*a* is formed. In a conductive wire flattening process, the second conducting wound member 22*a* is formed into a plate shape by flattening processing, thereby forming the second conductive wire 22. This flattening process brings the opposing surfaces that have been wound on the interior of the second conducting wound member 22*a* into close proximity or close contact, thus forming a flat-plate shaped second conductive wire 22.

Figure 9C:
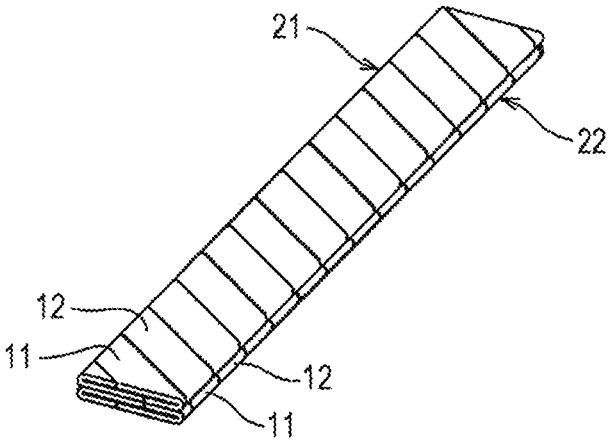
FIG. 9C is a perspective view illustrating procedures for processes of the manufacturing method according to the present embodiment.

In a laminating process, the first conductive wire 21 and second conductive wire 22 are disposed side-by-side in the longitudinal direction of each, being overlaid and laminated so that the surfaces in the width direction of each face each other, thus configuring the laminated conductive wire 20, as illustrated in FIG. 9C.

Figure 9D:
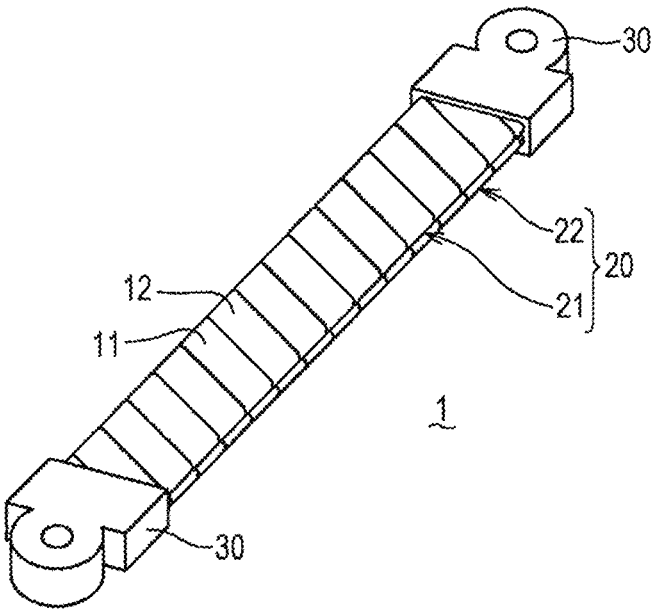
FIG. 9D is a perspective view illustrating procedures for processes of the manufacturing method according to the present embodiment.
Figure 10:
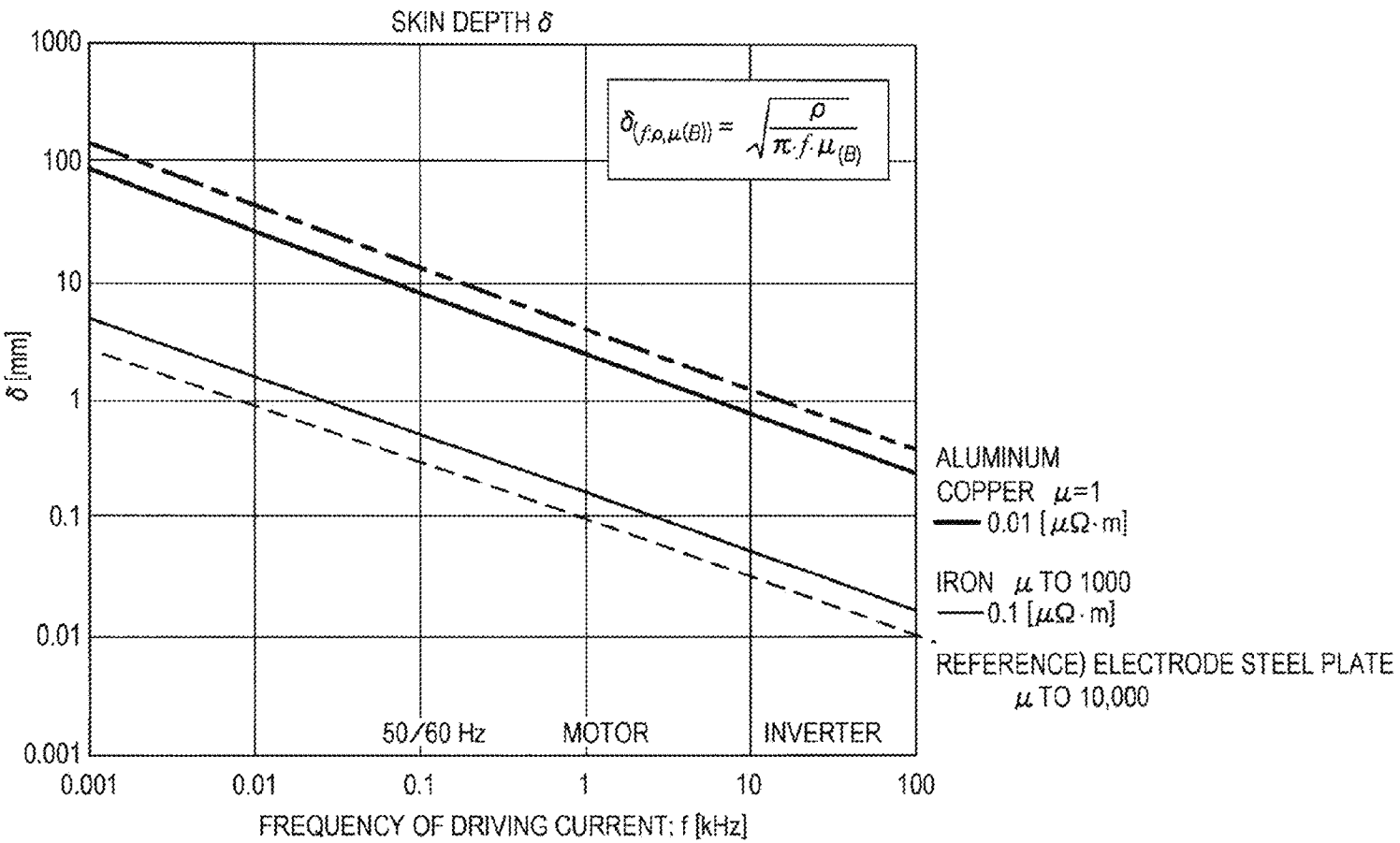
FIG. 10 is a graph illustrating the relationship between driving current frequency and skin depth regarding various types of conducting materials.
Figure 11:
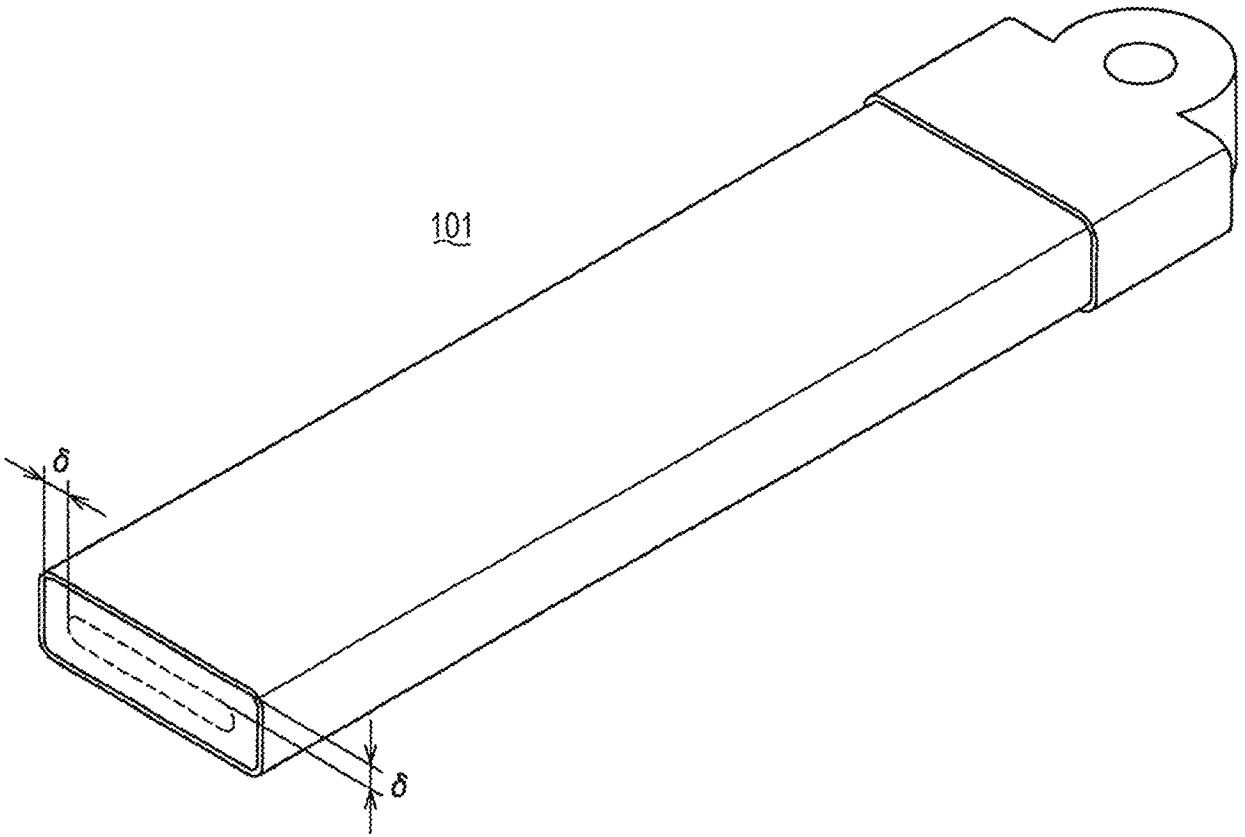
FIG. 11 is a perspective view illustrating a bus bar made up of a rectangular wire, according to the conventional art.
Figure 12A:
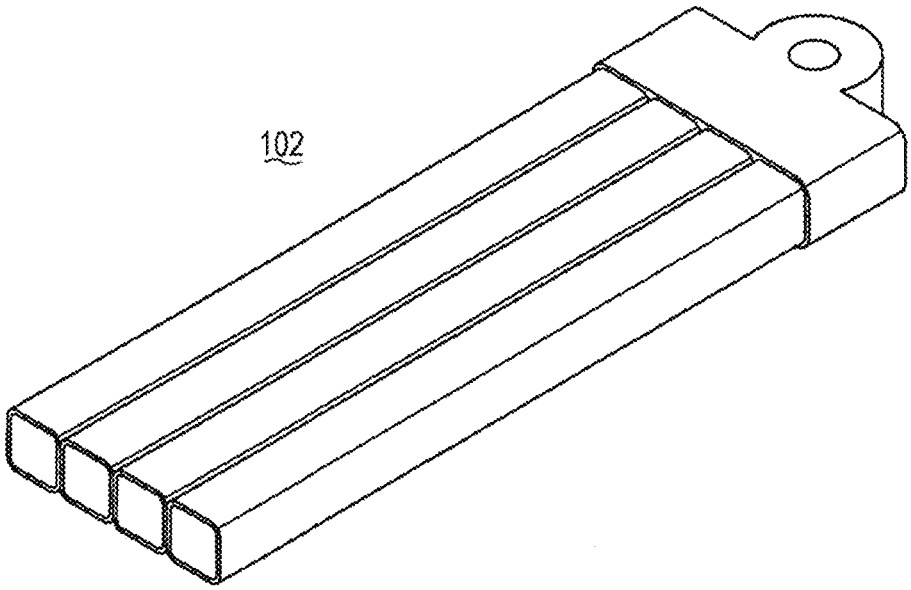
FIG. 12A is a perspective cross-sectional view illustrating a bus bar made up of multiple rectangular wires, arrayed sideways in parallel, according to the conventional art.
Figure 12B:
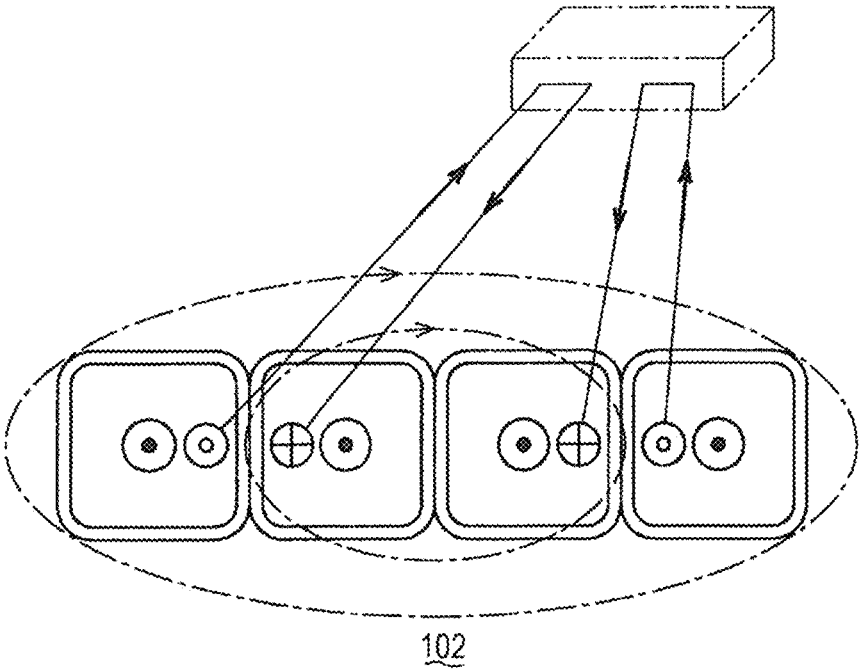
FIG. 12B is a cross-sectional view illustrating a bus bar made up of multiple rectangular wires, arrayed sideways in parallel, according to the conventional art.
Figure 13A:
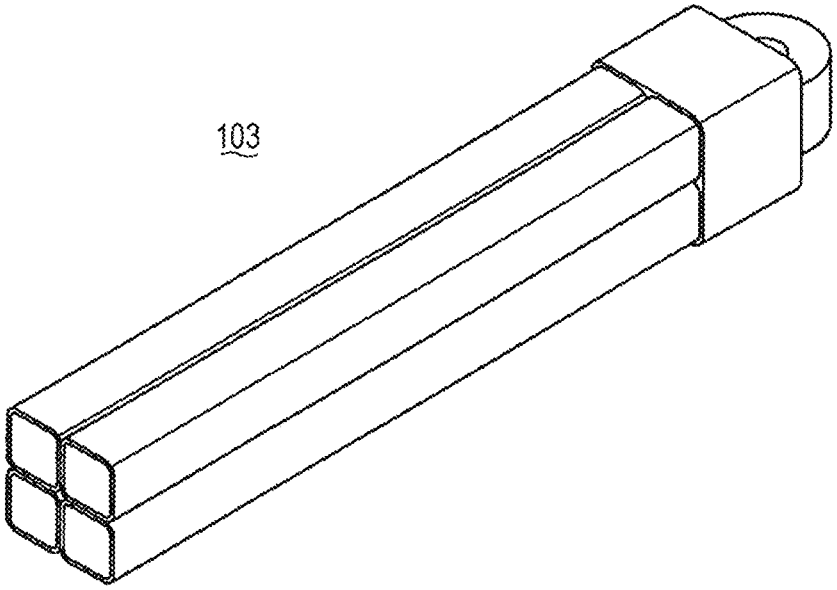
FIG. 13A is a perspective cross-sectional view illustrating a bus bar made up of multiple rectangular wires, arrayed sideways and vertically in parallel, according to the conventional art.
Figure 13B:
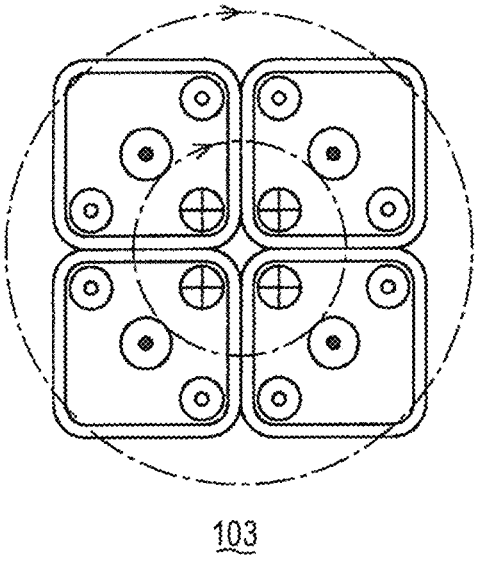
FIG. 13B is a cross-sectional view illustrating a bus bar made up of multiple rectangular wires, arrayed sideways and vertically in parallel, according to the conventional art.

Next, in a terminal part bonding process, the terminal parts 30 for electric connection are disposed on both ends of the laminated conductive wire 20 and bonded to the first conductive wire 21 and the second conductive wire 22, as illustrated in FIG. 9D.

Thus, according to the manufacturing method of the bus bar of the present embodiment, the two stripe conductors 11 and 12 of the first conductive wire 21 and second conductive wire 22 interchange between the outer side of the laminated conductive wire 20 and the inner side following the longitudinal direction. That is to say, the stripe conductors 11 and 12 are wound in spiral shapes opposite to each other, and due to this structure, the stripe conductors 11 and 12 which where on the surface of the laminated conductive wire 20 enter the interior at the following pitch. Accordingly, current flows through the stripe conductors 11 and 12 regardless of outer side/inner side of the laminated conductive wire 20 so effective cross-sectional area can be secured, and suppressing the eddy current loss to a low level enables the skin effect of the high-frequency current to be effectively suppressed. Also, the stripe conductors 11 and 12 are wound in opposite direction in spiral form, so the coil-like spiral current causes increase in internal inductance. However, the first conductive wire 21 where the stripe conductors 11 and 12 are wound in spiral form and the second conductive wire 22 where the stripe conductors 11 and 12 are wound in spiral form in the opposite direction are laminated side-by-side in the longitudinal direction, so the magnetic flux lines spreading in the vicinity of each are canceled out for the greater part. Accordingly, increase in the internal inductance can be minimized as a whole of the bus bar 1. Thus, the eddy current loss is suppressed and the skin effect is avoided, and not only low-frequency current but also high-frequency current can be made to flow through the interior of the bus bar 1, and current can be made to flow at the entire cross-section over a wide frequency range. Accordingly, transmission loss can be effectively suppressed from the low-frequency basic waves to high-frequency waves due to modulation.

While a preferred embodiment of the present invention has been described, the present invention is not restricted to the above-described embodiment or examples, and that various modifications may be made within the scope of the Claims set forth.

While the bus bar 1 according to the above-described present embodiment has the first conductive wire 21 and the second conductive wire 22 wound in spiral form in the opposite direction to each other, this is not restrictive. That is to say, in order to minimize inductance by suppressing eddy current, the bus bar 1 needs to be configured having the first conductive wire 21 and the second conductive wire 22 wound in spiral form in the opposite direction to each other. However, if a certain level of inductance is permissible, the bus bar 1 may be configured having two of the conductive wires (i.e., the first conductive wire 21 or the second conductive wire 22) both wound in spiral form in the same direction.

While the manufacturing method of the bus bar 1 according to the present embodiment described above involves manufacturing the first conducting wound member 21*a* by winding the stripe conductors 11 and 12 in the first conductive wire winding process in spiral form, and manufacturing the second conducting wound member 22*a* by winding the stripe conductors 11 and 12 in the second conductive wire winding process in the opposite direction to that of the first conducting wound member in spiral form, this is not restrictive. That is to say, in order to minimize inductance by suppressing eddy current, the bus bar 1 needs to be configured having the first conductive wire 21 and the second conductive wire 22 wound in spiral form in the opposite direction to each other. However, if a certain level of inductance is permissible, the bus bar 1 may be configured having two of the conductive wires (i.e., the first conductive wire 21 or the second conductive wire 22) both wound in spiral form in the same direction. Also, for the conductive wire winding process, one process of the first conductive wire winding process and second conductive wire winding process may be performed twice, thereby manufacturing two conducting wound members ((the first conducting wound member 21*a* or the second conducting wound member 22*a*) where the stripe conductors 11 and 12 are wound in spiral form in the same direction.

While the manufacturing method of the bus bar 1 according to the present embodiment described above involves performing a conductive wire flattening process on the first conducting wound member 21*a* while performing the first conductive wire winding process, and performing a conductive wire flattening process on the second conducting wound member 22*a* while performing the second conductive wire winding process, this is not restrictive. That is to say, after having performed the first conductive wire winding process and the second conductive wire winding process, the first conducting wound member 21*a* and the second conducting wound member 22*a* may each be subjected to the conductive wire flattening process.

The bus bar 1 according to the above-described embodiment has the same number of stripe conductors making up the first conductive wire 21 and the second conductive wire 22, and the stripe conductors making up each are the two stripe conductors 11 and 12 having the same width, but this is not restrictive. It is sufficient for the first conductive wire 21 and second conductive wire 22 to have the stripe conductors arrayed in adjacent in the width direction. Configuration may be of one stripe conductor of the same width, or may be of three or more stripe conductors. The number of stripe conductors making up the first conductive wire 21 and the number of the second conductive wire 22 may be different, and the width of the stripe conductors making up the first conductive wire 21 and the width of the second conductive wire 22 may be different. Note however, that in a case where the number of stripe conductors making up each of the first conductive wire 21 and the second conductive wire 22 is the same, and the stripe conductors making these up are of the same width, there is the advantage that the structure is simple, and forming and wiring implementation is easy. Also, in a case where even one of the first conductive wire 21 and the second conductive wire 22 is configured using a single stripe conductor, the combination of width of the bus bar 1 and spiral pitch will be singularly defined. Accordingly, the width of the bus bar 1 will be narrower than the width of the stripe conductor, or the length of the bus bar 1 in the longitudinal direction will be longer than necessary, so the geometric forms where the AC resistance is smaller than the bus bar according to the conventional art (e.g., bulk material bus bar) will be extremely limited. That is to say, a configuration of the bus bar 1 according to the present embodiment where the number of the first conductive wire 21 and second conductive wire 2 is two, is preferably from the perspective of forming and wiring implementation. The case where the number of the first conductive wire 21 and second conductive wire 22 is two is in particular a simple structure where the bus bar width and the spiral pitch can be suitably combined, and also the number of parts is few, and accordingly is most preferably regarding forming and wiring implementation as well.

Also, while a straight type and a crank type have been described for the bus bar module 2 described above, this is not restrictive. Any shape may be formed in accordance with the location where the bus bar module is to be installed.

Also, the terminal part 30 of the bus bar 1 according to the present embodiment described above is not restricted to the shape illustrated in FIG. 1, and terminal parts 30 of various shapes may be used.

EXAMPLES

First Example

A first example of the bus bar 1 according to the present embodiment was subjected to AC resistance analysis. The results thereof will be described in detail below with reference to FIG. 14.

In the first example, a copper plate 0.6 mm in total thickness, which is 1 mm to several mm thinner than a commercially-used article actually used as bus bar 1, was used and frequency dependency of AC resistance was measured. In the first example, the first conductive wire 21 and the second conductive wire 22 were manufactured from two stripe conductors 11 and 12 0.15 mm t thick×19 mm W wide by the bus bar 1 manufacturing method according to the above-described embodiment. The first conductive wire 21 and the second conductive wire 22 where then brought into close contact, thereby manufacturing a laminated conductive wire 20 0.6 mm t thick×19 mm W wide to which terminal parts 30 were bonding, thus manufacturing a bus bar 1 which was used. The bus bar 1 according to the first example was manufactured so that the entire length was 6 m L.

Also, a bulk material bus bar 0.6 mm t thick×19 mm W wide (the same width as the bus bar 1 according to the first example) and having an entire length of 6 m L (the same entire length as the bus bar 1 according to the first example) was prepared, for comparison according to the first example. The frequency dependency of AC resistance was measured for this bulk material bus bar, in the same way as with the bus bar 1 according to the first example. Further, four rectangular wires 0.15 mm t thick×19 mm W wide (the same width as the bus bar 1 according to the first example) and having an entire length of 6 m L (the same entire length as the bus bar 1 according to the first example) were integrated side-by-side to configure an integrated rectangular wire, as a mock-up of the conventional art. The frequency dependency of AC resistance was measured for this 4-ply bus bar, in the same way as with the bus bar 1 according to the first example.

Figure 14:
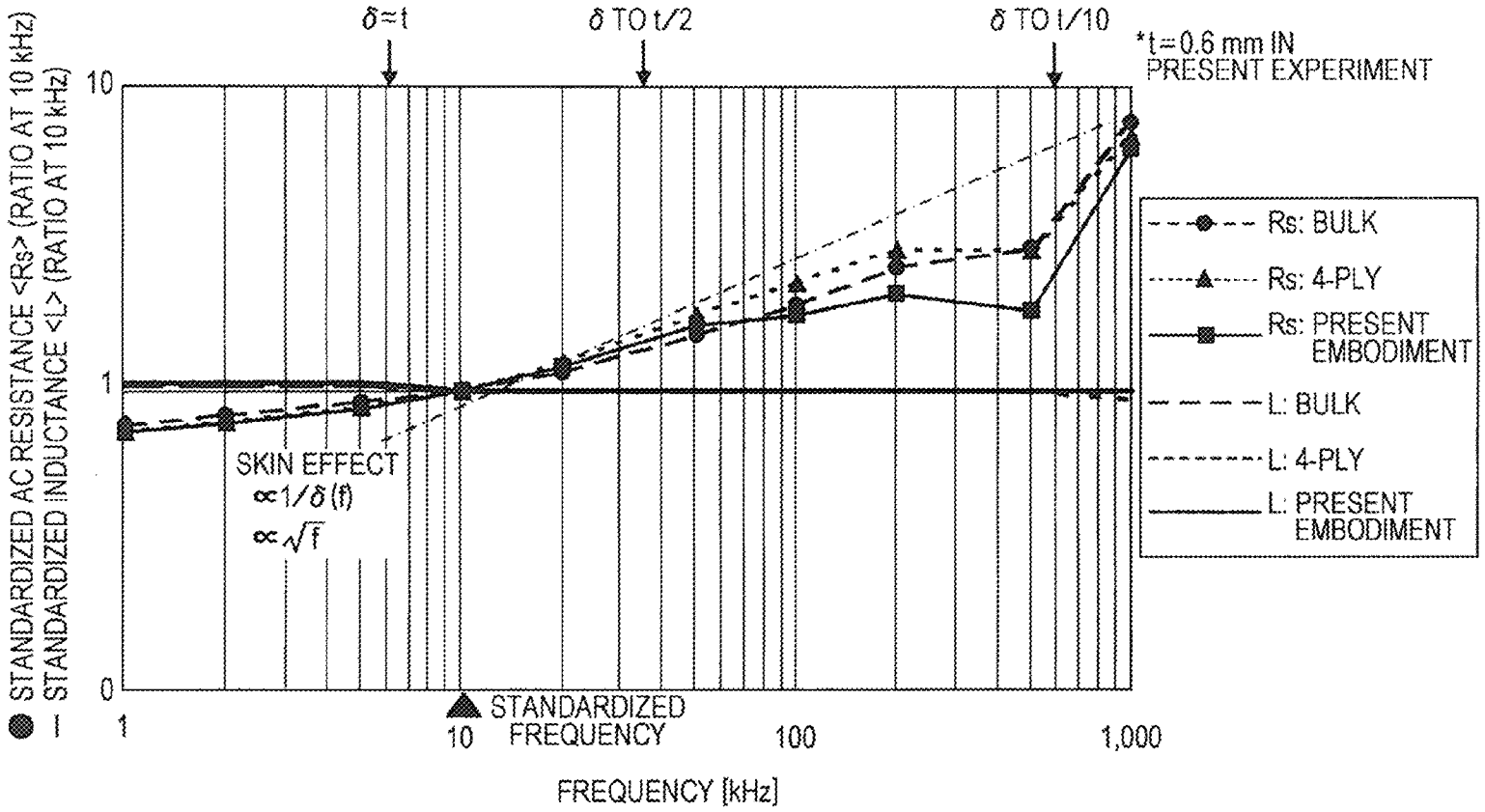
FIG. 14 is a graph illustrating the results of measuring frequency dependency of AC resistance with regard to a bus bar according to a first example, a bulk material bus bar, and a 4-ply bus bar.

Frequency properties were measured of inductance (Ls) and AC resistance (Rs) as the frequency dependency of AC resistance, using an LCR meter under the same conditions for all articles. FIG. 14 illustrates the results of measuring frequency dependency of AC resistance with regard to the three samples of the bus bar according to the first example, a bulk, and a 4-ply. FIG. 14 has labeled the measurement results of the bus bar 1 according to the present embodiment as "present embodiment", the measurement results of the bulk material bus bar as "bulk", and the measurement results of the 4-ply material bus bar as "4-ply".

FIG. 14 shows that the values for Ls and Rs exhibited approximately the same values at low-frequency waves. However, there is slight error in the individual dimensions, so a particular frequency (10 KHz in the first example) near a frequency where the skin depth δ is the total thickness t (=0.6 mm) of the bus bar 1 was set as a standardized frequency, and the ratio as to the L and Rs values of the standardized frequency are plotted as standardized inductance <L> and standardized AC resistance <Rs>. A scale is specified at the upper part of FIG. 14 indicating the ratio between the kin depth δ and total thickness t of the bus bar with regard to the frequency.

As illustrated in FIG. 14, the standardized inductance <L> exhibits a constant value with good precision, regardless of the frequency. On the other hand, the standardized AC resistance <Rs> increases exponentially at an incline of around ½ the frequency or less, at a frequency where δ=t or higher, but there is no significant difference between the bulk bus bar and the 4-play bus bar. Accordingly, it can be seen that the 4-ply bus bar has not effect of reducing eddy current loss due to high-frequency current.

On the other hand, the value of the bus bar 1 according to the first example markedly exhibits a far smaller value in comparison with the bulk bus bar and the 4-ply bus bar in a region where the skin depth δ is ½ to 1/10 the total thickness t of the bus bar (exhibits low resistance). As for the upper limit of this effect, the skin depth δ is equal to or smaller than the thickness of the stripe conductors 11 and 12 making up the bus bar 1 according to the present embodiment (0.15 mm t here) in a region where the skin depth δ is far smaller than 1/10 of the total thickness t of the bus bar. At this time, higher-order skin effect occurs within the structure conductor, and it is predicted that the effects of reduction of eddy current loss due to high-frequency current will decrease somewhat. Note however, that at frequency regions of MHz and above, preparing measurement conditions (eliminating parasitic capacitance L and parasitic capacitance C) and ensuring precision with a normal LCR meter is difficult, so measurement is difficult. It is thought that the deterioration in the effects of reduction of eddy current loss due to high-frequency current will around where the skin depth δ is 1/10 of the total thickness t of the bus bar in the graph illustrated in FIG. 14 according to this measurement is due to this measurement technology. Accordingly, it is though that in practice, the effects of reduction of eddy current loss due to high-frequency current will be maintained, and although there will be some deterioration, it should be less pronounced.

Second Example

A second example of the bus bar 1 according to the present embodiment was subjected to AC resistance analysis and current density distribution analysis. The results thereof will be described in detail below with reference to FIG. 15 through FIG. 18.

The bus bar 1 according to the second example was manufactured by the following procedures. First, stripe conductors 11 and 12 0.3 mm in thickness were wound in a spiral form with a gap of 0.4 mm therebetween. Thus, a first conductive wire 21 and second conductive wire 22 1.0 mm t thick×19 mm W wide were formed. Now, the gap between the stripe conductors 11 and 12 means a gap between the opposing surfaces on the interior of the wound stripe conductors 11 and 12, i.e., internal space in the first conductive wire 21 and the second conductive wire 22. The second conductive wire 22 was wound in spiral form in the opposite direction as to the first conductive wire 21. Next, the first conductive wire 21 and second conductive wire 22 were brought into close contact with a space of 0.3 mm therebetween, and thus a laminated conductive wire 20 2.3 mm t thick×19 mm W wide was manufactured. The laminated conductive wire 20 was then nipped to a depth of 15 mm by copper terminal parts 30 which were 6 mm t thick×19 mm W wide×30 mm L long, thus manufacturing the bus bar 1 according to the second example. The bus bar 1 according to the second example was manufactured such that the entire length was 334 mm.

Also, a bulk material bus bar was also subjected to AC resistance and frequency dependency in the same way as the bus bar 1 according to the second example, to compare with the bus bar 1 according to the second example. The bulk material bus bar was manufactured as follows. First, a conductive wire 1.2 mm t thick×19 mm W wide×304 mm L entire length was manufactured so as to have the same cross-section are as the bus bar 1 according to the second example. Next, the conductive wire was nipped to a depth of 15 mm by copper terminal parts 30 which were 6 mm t thick×19 mm W wide×30 mm L long, thus manufacturing the bulk material bus bar. The bulk material bus bar was manufactured such that the entire length was 334 mm, the same as with the bus bar 1 according to the second example.

Also, a 4-ply bus bar was also subjected to AC resistance and frequency dependency in the same way as the bus bar 1 according to the second example, to compare with the bus bar 1 according to the second example. The 4-ply bus bar was manufactured as follows. First, four rectangular wires 0.3 mm t thick×19 mm W wide (the same width as the bus bar 1 according to the second example) and having an entire length of 304 mm L (the same entire length as the bus bar 1 according to the second example) were integrated side-by-side. Next, in the same way as the bus bar 1, the gap between adjacent rectangular wires at the outermost and one on the inner side was set to 0.4 mm t, and the gap between the rectangular wires on the inner side was set to 0.3 mm t, so that the thickness was 2.3 mm t. The four rectangular wires were nipped to a depth of 15 mm by copper terminal parts 30 which were 6 mm t thick×19 mm W wide×30 mm L long, thus manufacturing the 4-ply bus bar. The 4-ply bus bar was manufactured such that the entire length was 334 mm, the same as with the bus bar 1 according to the second example.

Also, a 4-ply thin bus bar was also subjected to AC resistance and frequency dependency in the same way as the bus bar 1 according to the second example, to compare with the bus bar 1 according to the second example. The 4-ply thin bus bar was manufactured by setting the gaps between the rectangular wires in the above-described 4-ply bus bar to 0.1 mm t, and attaching the terminal parts 30.

(AC Resistance Analysis)

Figure 15:
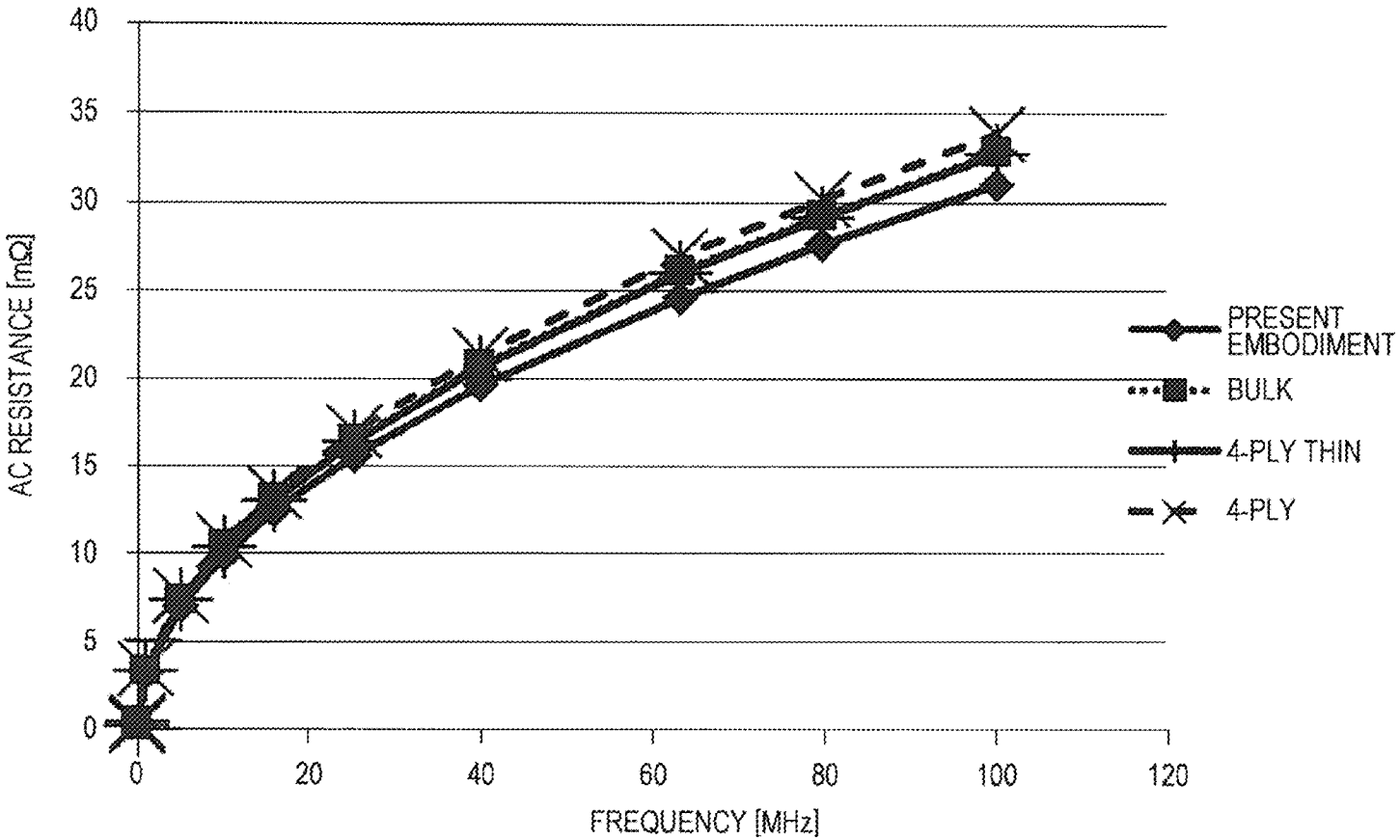
FIG. 15 is a graph illustrating the results of measuring frequency dependency of AC resistance Rs by magnetoestatic analysis according to the 3D boundary element method, with regard to a bus bar according to a second example, a bulk material bus bar, a 4-ply bus bar, and a 4-ply thin bus bar.
Figure 16:
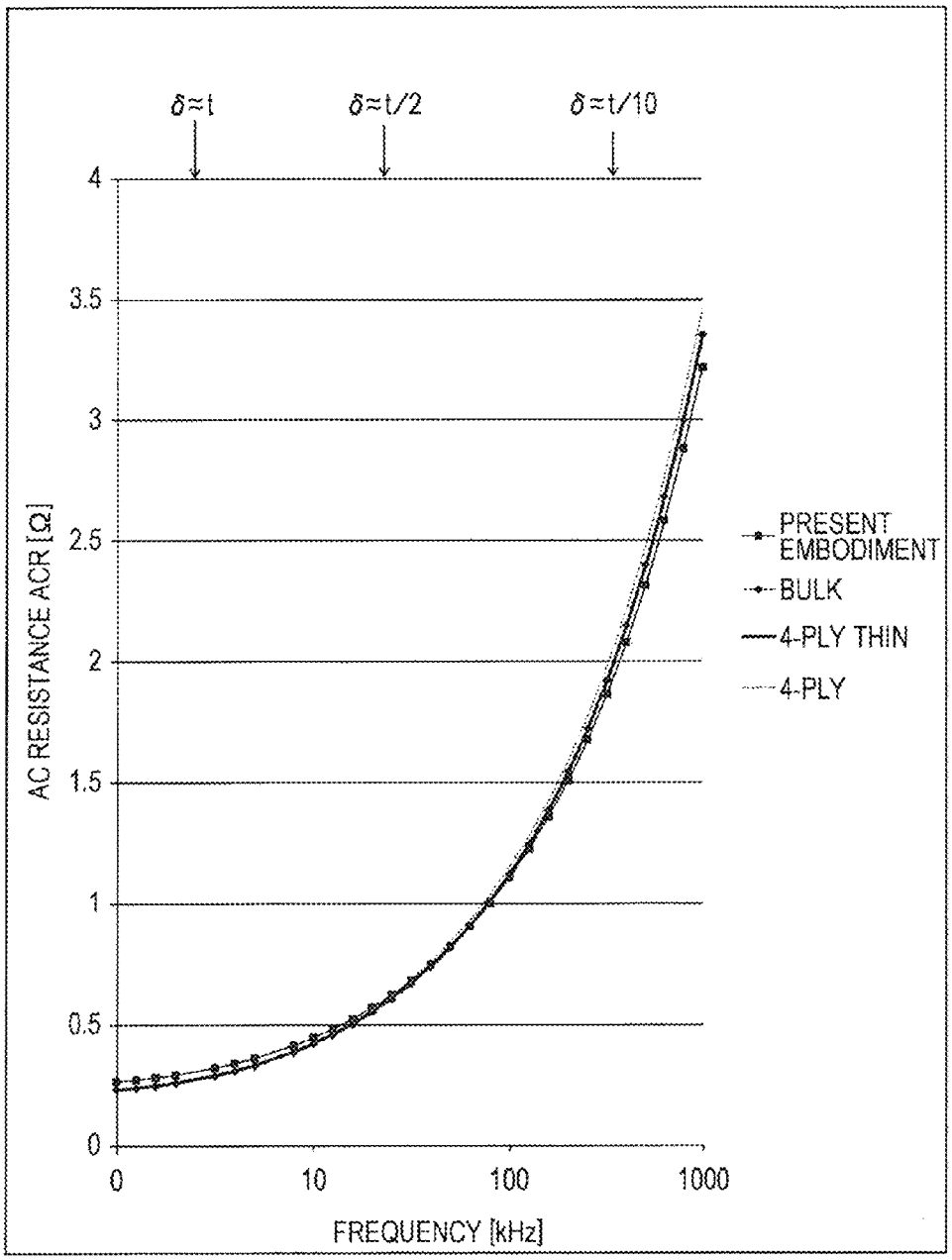
FIG. 16 is a graph illustrating AC resistance ACR frequency properties near skin depth, in the graph illustrated in FIG. 15.

The frequency dependency of AC resistance was analyzed from the bus bar 1 according to the second example, the bulk material bus bar, the 4-ply bus bar, and the 4-ply thin bus bar. FIG. 15 and FIG. 16 illustrate the results thereof. FIG. 15 illustrates the results of measuring frequency dependency of AC resistance Rs by magnetoestatic analysis according to the 3D boundary element method, with regard to a bus bar. FIG. 16 is a graph illustrating in an enlarged manner the AC resistance ACR frequency properties near skin depth, in the graph illustrated in FIG. 15. FIG. 15 and FIG. 16 have labeled the measurement results of the bus bar 1 according to the second example as "present embodiment", the measurement results of the bulk material bus bar as "bulk", the measurement results of the 4-ply material bus bar as "4-ply", and the measurement results of the 4-ply thin material bus bar as "4-ply thin".

It can be seen from FIG. 15 that the AC resistance Rs of the bus bar 1 according to the second example exhibits a smaller value as compared with the bulk bus bar. Also, the AC resistance Rs of the 4-ply thin bus bar where the gaps between the rectangular wires are smaller than the thickness of the rectangular wires is around the same level as the bulk material bus bar, as compared with the 4-ply bus bar where the gaps between the rectangular wires are larger than the thickness of the rectangular wires. Based on the above analysis results, confirmation was made that by reducing the gaps between the rectangular wires, i.e., by making the gaps between the rectangular wires to be smaller than the thickness of the rectangular wires, there was the effect of suppressed increase of internal inductance. Also, based on the results of this analysis, with the gap of the first conductive wire 21 and second conductive wire 22 as δt and the thickness of the stripe conductors 11 and 12 as Tt, it can be predicted that the effect of suppressing increase of internal inductance can be obtained by setting the ratio of δt as to Tt so as to be δt/Tt.

The bus bar 1 according to the second example exhibited a small value for the AC resistance ACR as compared with the bulk bus bar and 4-ply bus bar and 4-ply thin bus bar, in the region where the skin depth δ is ½ to 1/10, as illustrated in FIG. 16. It was thus confirmed from these analysis results that the bus bar 1 according to the second example was reducing eddy current loss due to high-frequency current.

(Current Density Distribution Analysis)

Figure 17:
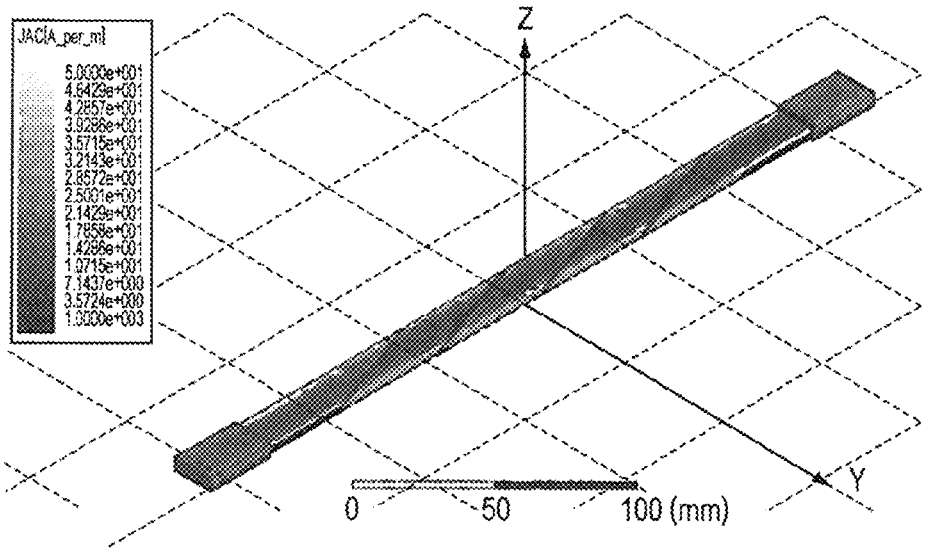
FIG. 17 is a perspective view illustrating a current density distribution of a bus bar according to a second example.
Figure 18:
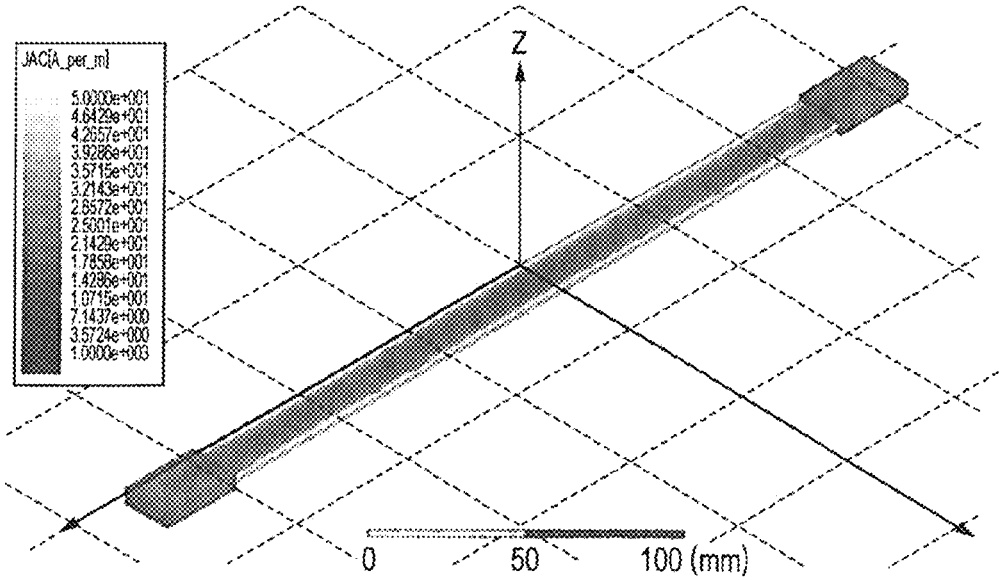
FIG. 18 is a perspective view illustrating a current density distribution of a bulk material bus bar.

The current density distribution was analyzed when high-frequency current of 30 MHz flows through the bus bar 1 according to the second example described above and the bulk bus bar. The results thereof are illustrated in FIG. 17 and FIG. 18. FIG. 17 illustrates current density distribution of the bus bar 1 according to the second example. FIG. 18 illustrates current density distribution of the bulk bus bar.

It can be seen from FIG. 17 and FIG. 18 that the bus bar 1 according to the second example has a wider and more average distribution of current density at the surface of the conductor, in comparison with the bulk bus bar. This is because the 30 MHz high-frequency current is flowing at the inner side of the laminated conductive wire 20 as well in the bus bar 1 according to the second example, so the effective cross-sectional are is wider, and the surface current density has dropped.

This application is based on Japanese Patent Application No. 2012-286995 filed Dec. 28, 2012, the contents of which are hereby incorporated by reference.

REFERENCE SIGNS LIST

1 bus bar
2 bus bar module
11 stripe conductors
12 stripe conductors
20 laminated conductive wire
21 first conductive wire (two conductive wires)
21*a* first conducting wound member (two conducting wound members)
22 second conductive wire (two conductive wires)
22*a* second conducting wound member (two conducting wound members)
30 terminal part

The invention claimed is:

1. A bus bar used for electric connection, comprising:

a laminated conductive wire, where two or more conductive wires, configured by one or a plurality of stripe conductors covered with an insulating film having been wound in a spiral form so as to be adjacent in a width direction of the stripe conductor, are configured in a flat plate form so that opposing surfaces of a wound interior are in proximity or in close contact are disposed side-by-side in a longitudinal direction of each, and overlaid and laminated so that an outer surface of each in the width direction face each other; and terminal parts, disposed on both ends of the laminated conductive wire and bonded to the two conductive wires, wherein the two conductive wires include a first conductive wire where one or a plurality of stripe conductors covered with an insulating film are wound in a spiral form so as to be adjacent in a width direction of the stripe conductor, and configured in a flat plate form so that opposing surfaces of a wound interior are in proximity or in close contact, and a second conductive wire where one or a plurality of stripe conductors covered with an insulating film are wound in a spiral form, in an opposite direction to the first conductive wire, so as to be adjacent in a width direction of the stripe conductor, and configured in a flat plate form so that opposing surfaces of a wound interior are in proximity or in close contact.

2. The bus bar according to claim 1, wherein the number of the stripe conductors making of each of the conductive wires is the same, and the width of the stripe conductors making of each of the conductive wires is the same.

3. The bus bar according to claim 2, wherein the number of stripe conductors making up each of the two conductive wires is two.

4. The bus bar according to claim 1, wherein an aspect ratio of thickness of the laminated conductive wire as to the width thereof is 1 or smaller.

5. The bus bar according to claim 1, wherein with a gap between the first conductive wire and second conductive wire as δt and the thickness of the stripe conductors as Tt, the dimensional ratio is such that the ratio δt/Tt of δt as to Tt is 1 or smaller.

6. The bus bar according to claim 1, wherein the bus bar is used for electric connection to conduct pulse width modulated current.

7. The bus bar according to claim 1, wherein the bus bar is used for electric connection between an electric motor and an inverter.

8. A bus bar module, formed by integrally assembling bus bars according to claim 1 formed in a predetermined shape, disposed in close contact so that surfaces thereof in the width direction face one another.

9. A bus bar used for electric connection, comprising:

a laminated conductive wire, where two or more conductive wires, configured by one or a plurality of stripe conductors covered with an insulating film having been wound in a spiral form so as to be adjacent in a width direction of the stripe conductor, are configured in a flat plate form so that opposing surfaces of a wound interior are in proximity or in close contact are disposed side-by-side in a longitudinal direction of each, and overlaid and laminated so that an outer surface of each in the width direction face each other; and terminal parts, disposed on both ends of the laminated conductive wire and bonded to the two conductive wires, wherein with the width of the laminated conductive wire as W, the thickness of the laminated conductive wire 20 as T, the width of the stripe conductors 11 and 12 as ω, and half of the spiral pitch of the stripe conductors as λ, a combination of the dimensional ratios of T/W and λ/W regarding the skin depth $\delta=(\rho/\pi f\mu)^{1/2}$ from the frequency f of the current which the bus bar conducts and the resistivity ρ and magnetic permeability μ, of the stripe conductors satisfies the following Expression (1).

[Math 1]

$$\left.\begin{array}{l} \dfrac{1}{\omega/W}\cdot\dfrac{\sqrt{(\lambda/W)^2+1}}{\lambda/W}(1+T/W)\cdot\dfrac{2\delta}{T}\leq 1 \\ \qquad\qquad \text{or} \\ \dfrac{1}{\omega/W}\cdot\dfrac{\sqrt{(\lambda/W)^2+1}}{\lambda/W}(1+T/W)\leq\dfrac{T}{2\delta_{(f)}} \\ \text{where}\quad \lambda\langle\langle L\ (L\text{: line length}) \end{array}\right\}. \tag{1}$$

* * * * *